US005962806A

United States Patent [19]

Coakley et al.

[11] Patent Number: 5,962,806

[45] Date of Patent: Oct. 5, 1999

[54] NON-LETHAL PROJECTILE FOR DELIVERING AN ELECTRIC SHOCK TO A LIVING TARGET

[75] Inventors: Peter G. Coakley, Cardiff; Edward J. Vasel, San Diego; Scott C. Nunan, San Diego; Gregory A. Niederhaus, San Diego; Norbert C. Wild, Jr., San Diego; Charles E. Mallon, San Diego; Raymond Denson, San Diego, all of Calif.

[73] Assignee: Jaycor, San Diego, Calif.

[21] Appl. No.: 08/746,326

[22] Filed: Nov. 12, 1996

[51] Int. Cl.[6] ..... F24B 12/00

[52] U.S. Cl. ..... 102/502; 102/293; 102/513; 89/1.11; 361/232

[58] Field of Search ..... 102/293, 258, 102/259, 260, 261, 262, 264, 502, 395, 444, 498, 501, 513, 529; 361/230, 231, 232, 233, 235; 473/574, FOR 211; 89/1.11; 463/47.3

[56] References Cited

U.S. PATENT DOCUMENTS

| | | | |
|---|---|---|---|
| 8,843 | 3/1852 | Sonnenburg et al. . | |
| 2,805,067 | 9/1957 | Ryan . | |
| 2,831,431 | 4/1958 | Stevenson et al. | 102/260 |
| 3,209,695 | 10/1965 | Crockford et al. | 102/92 |
| 3,523,538 | 8/1970 | Shimizu | 124/15 |
| 3,626,626 | 12/1971 | Blanc | 43/6 |
| 3,732,821 | 5/1973 | Royer | 102/41 |
| 3,803,463 | 4/1974 | Cover | 317/262 |
| 3,857,566 | 12/1974 | Lemelson et al. | 273/95 R |
| 4,253,132 | 2/1981 | Cover | 361/232 |
| 4,337,496 | 6/1982 | Laird | 361/454 |
| 4,424,932 | 1/1984 | Allen | 361/232 |
| 4,541,402 | 9/1985 | Winters | 124/27 |
| 5,131,602 | 7/1992 | Linick | 244/3.19 |
| 5,202,533 | 4/1993 | Vandersteen | 102/512 |
| 5,317,914 | 6/1994 | Franco | 73/167 |
| 5,473,501 | 12/1995 | Claypool | 361/394 |
| 5,649,466 | 7/1997 | Genovese | 89/1.11 |
| 5,698,815 | 12/1997 | Ragner | 102/502 |
| 5,750,918 | 5/1998 | Mangolds et al. | 102/502 |

FOREIGN PATENT DOCUMENTS

| | | | |
|---|---|---|---|
| 4-70790 | 9/1914 | France | 102/444 |

OTHER PUBLICATIONS

*Medical & Biol. Engng.;* "A Simple Battery–Powered Stimulator for Aversion Therapy";Vol. 6: pp. 445–446 (1968).

*AIEE Technical Paper 43–134*; "Effect of Frequency on Let–Go Currents"; (1944).

"Electronic Paralyzing Device (PG1W)", Chapter 27, pp. 351–363 (No additional information available on this reference. Received in our offices on Sep. 19, 1995.

*Primary Examiner*—Harold J. Tudor

*Attorney, Agent, or Firm*—Fitch, Even, Tabin & Flannery

[57] ABSTRACT

An projectile and method of using same employ a projectile body; an electric circuit housed within the projectile body; a plurality of electrodes, coupled to the electric circuit, for delivering an electrical shock to the target; and attachment means, coupled to the projectile body, for attaching the projectile to the target.

63 Claims, 11 Drawing Sheets

NON-LETHAL PROJECTILE FOR DELIVERING AN ELECTRIC SHOCK TO A LIVING TARGET

BACKGROUND OF THE INVENTION

The present invention relates to non-lethal projectiles, and more particularly to wireless, non-lethal projectiles for delivering an electric circuit to a target. Even more particularly, the present invention relates to wireless, non-lethal projectiles for delivering an electric shock-delivering circuit to a living animal.

It is no secret that steadily rising crime rates and an increased need for crime control have created a need for technologically enhanced crime fighting devices. In particular, there is a need for non-lethal devices that are capable of incapacitating or inhibiting suspects in a group of innocent bystanders, mentally deranged individuals, or suspected criminals fleeing on foot. For example, devices that stun, impair the vision of, impair the breathing of, or otherwise physically or mentally impair suspected criminals are needed.

One attempt to provide a non-lethal device for delivering an inhibiting substance is shown in U.S. Pat. No. 3,921,614, issued to Fogelgren for COMPRESSED GAS OPERATED GUN HAVING VARIABLE UPPER AND LOWER PRESSURE LIMITS OF OPERATION, incorporated herein by reference (hereinafter the '614 patent). The '614 patent describes a gas-operated gun and associated projectiles. In one illustrated embodiment, a projectile consists of a projectile casing that houses a structure in which a firing pin is situated so as to detonate a primary charge upon impact of the projectile with a target. Detonation of the primary charge causes the expulsion of a load carried in a load chamber. The load chamber may contain various types of load, such as tear gas, dye, flash-powder or wading.

Another embodiment illustrated in the '614 patent consists of a projectile casing that encloses a body member, which together with a frontal member defines a load chamber. The body member and the frontal member are attached so as to be readily separable in flight to enable the load to escape from the load chamber and to proceed to the desired target. In this embodiment, the load is buckshot or plastic pellets.

A further embodiment of the projectile shown by the '614 patent stores a portion of a compressed gas utilized to expel the projectile to expel a load upon striking a target. Upon firing, an outer body member separates from an inner body member, exposing and releasing a holding pin that prevents premature release of the projectile's load. Apertures from which the load is expelled upon impact are sealed with wax to prevent expulsion of the load before the projectile impacts the target. The portion of the pressurized gas is stored in a rear chamber of the projectile during flight while the load is stored in a forward chamber. When the projectile strikes the target, the pressurized gas is released forcing the load through the apertures and out of the projectile.

An additional embodiment of the projectile shown by the '614 patent consists of outer members that form a container into which is fitted a breakable glass vile. Rearward of the breakable vile, padding is provided to prevent breakage of the vile upon firing of the projectile. Forward the vile is a firing pin assembly against which the breakable vile impacts as it shifts forward within the members forming the container upon impact. As with the above embodiment, a holding pin, which normally prevents the breakable vial from shifting forward in the container, is expelled as an outer body member separates from an inner body member. This allows the breakable vial to shift forward upon impact, shattering the breakable glass vial against the firing pin. The breakable glass vile contains a load to be delivered to the target, which is delivered through apertures near the front of the projectile upon the shattering of the breakable glass vial. The vile may be charged with a compressed gas so as to provide a charged load.

Disadvantageously, most of the approaches shown by the '614 patent involve projectiles that are fired, strike, and deliver their load to and instantaneously glance off of their target. Thus, such approaches are unable to continuously and/or repeatedly deliver their stunning or inhibiting effects. If their initial load is unsuccessful in stunning or sufficiently inhibiting the target, projectiles must be repeatedly fired at the target in hopes of again striking the target and eventually achieving adequate stunning or inhibiting of the target.

Another approach to stunning or inhibiting a fleeing or aggressive criminal is embodied in what is commonly known as a "stun gun". The stun gun employs a pair of high energy electrodes positioned at a distal end of a handle. Within the handle an electrical circuit generates a high energy electrical signal, which is applied to the electrodes. Upon contact of the electrodes with the fleeing or aggressive target, an electrical shock is delivered to the target, as he, she or it completes an electrical circuit between the electrodes. Unfortunately, in order to use the stun gun, the user must come into very close contact with the target, in order to make contact between the electrodes and the target. This proximity not only places the user in a position of significant personal risk of physical harm, but risks the target gaining possession of the stun gun, and turning it on the user.

Another approach to stunning or inhibiting a fleeing or aggressive target, is embodied in what is commonly known as a "taser". The taser employs a pair of projectile darts having long sharpened, barbed tips designed to penetrate clothing or animal flesh, such as human flesh. In operation, the taser is fired at the fleeing or aggressive target, with the hope that the sharpened, barbed tips embed in the flesh of the target. If the tips do embed in the flesh of the target, wires, which are connected between the darts and the taser itself, are used to deliver a high-energy electrical shock through the barbed tips to the target, who completes an electrical circuit between the barbed tips of the darts. Note however that both of the barbed tips must attach to the target and come into close contact with the flesh of the target for the electrical circuit to be completed.

Unfortunately, if one or both of the darts do not hit and implant in the target, the electrical circuit will not be completed and the taser is unable to deliver the electrical shock. In this case, the taser is rendered useless. Thus, the taser can be characterized as a wired double projectile approach in which both of the projectiles must hit and implant into the target in order for the taser to be effective. Furthermore, once the taser has been fired, it cannot be easily reloaded, and fired a second time, due to the wires connecting the taser and darts and other physical limitations of heretofore known tasers. Such wires further limit the range and velocity of the darts and thereby limit the utility of the taser to the length of the wires and the speed with which the wires can be deployed.

Additionally, even if the darts do embed in the flesh of the target, the user of the taser (or at least the taser) must remain proximate to the target until he/she is subdued, so that the wires are not broken, or tensioned to a point where either the darts are ripped out of the target's flesh, or the taser itself is pulled out of the user's hands.

A further disadvantage of the taser is that one or both of the darts may implant in the target's skin, may cause significant physical harm to the target. This is especially true if the target attempts to remove the darts from his/her flesh. In particular, unless care is exercised in firing the taser, the darts may actually prove very damaging or even lethal if they imbedded, for example, the target's throat, eyes or head. Thus, the taser, while having some commercial success, does not provide an adequate non-lethal mechanism for stunning or inhibiting a living animal, especially if the target is fleeing.

What is needed is a non-lethal approach to stunning or inhibiting a target that does not require direct touching of the target with a hand-held apparatus, such as a stun gun, and furthermore, that does not require the use of long sharpened, barbed tips that may embed into a target's skin. In addition what is needed is a single projectile, non-lethal approach to stunning or inhibiting a target that is not range-limited by wires coupled to darts, such as with a taser, and furthermore that can be easily reloaded if an initial firing is unsuccessful. Additionally what is needed is a non-lethal approach to stunning or inhibiting a target that is able to deliver repeated stunning or inhibiting effects without the need for repeated firings of projectiles, such as is required by the embodiments of the '614 patent.

Thus, as will be appreciated by one skilled in the art, significant improvements are needed in non-lethal approaches for stunning or inhibiting a living target. The present invention advantageously addresses the above and other needs.

SUMMARY OF THE INVENTION

The present invention advantageously addresses the needs above as well as other needs by providing a wireless, non-lethal, single projectile approach for delivering an electric circuit, e.g., an electric-shock-delivery circuit, to a target.

The present invention, in one embodiment, can be characterized as a projectile for delivering a stunning electrical shock to a target. Such projectile has a projectile body; an electric circuit housed within the projectile body; a plurality of electrodes, coupled to the electric circuit, for delivering an electrical shock to the target; and an adhesive material or mechanical attachment system, coupled to the projectile body, for attaching the projectile to the target.

In a variation, the above embodiment may have an adhesive-containing capsule coupled to the front end of the projectile body. The adhesive material is contained within the adhesive-containing capsule until the impact of the projectile against the target. The adhesive-containing capsule ruptures upon the impact of the projectile against the target, and the adhesive material is released onto the target in response to the rupturing of the adhesive-containing capsule.

In an additional variation, the above embodiment may employ one or more barbed tips coupled to the projectile body for attaching to the target, e.g., for attaching to the target's clothing. The barbed tips may or may not themselves, in various versions of the present variation, serve as one or more of the plurality of electrodes.

In another embodiment, the invention can be characterized as a method of inhibiting a living target having steps of firing a projectile at the target; impacting the target with the projectile having been fired; attaching the projectile to the target; generating a voltage within the projectile; and delivering an electrical shock to the target using the voltage having been generated.

In a further embodiment, the invention can be characterized as a system for delivering a stunning electrical shock to a target using a launch device and a projectile. The projectile employs a projectile body; an electric circuit housed within the projectile body; a plurality of electrodes, coupled to the electric circuit, for delivering an electrical shock to the target; and an adhesive material or mechanical attachment system, coupled to the projectile body, for attaching to the target.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
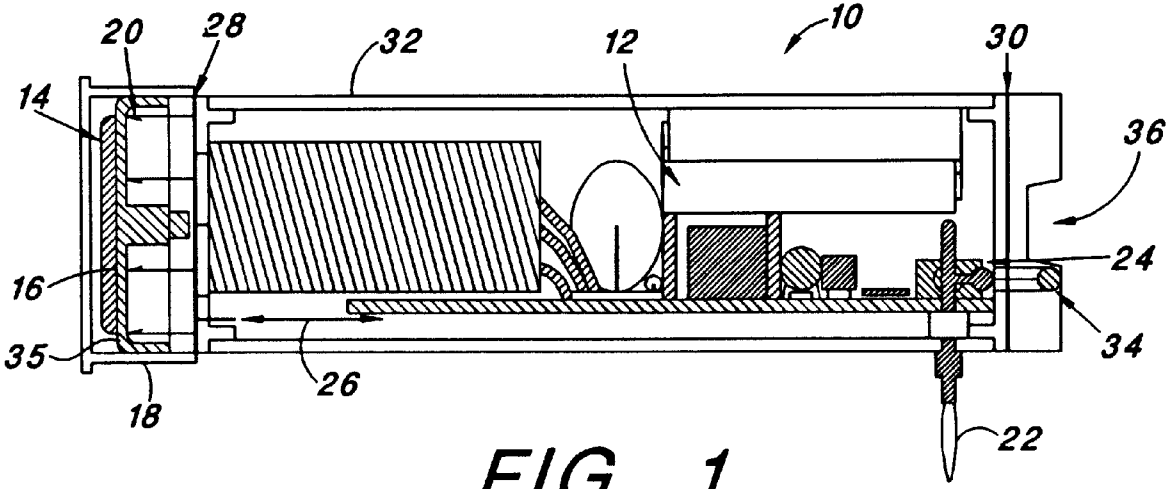
FIG. 1 is a partial side cross-sectional view of a non-lethal projectile in accordance with one embodiment of the present invention wherein electrodes comprise a pair of metallic bands located respectively at a forward and a rearward end of the projectile.

Referring next to FIG. 1, a partial side cross-sectional view is shown of an embodiment of a non-lethal projectile 10 for delivering an electric-shock-delivering circuit 12 to a target. The projectile 10 is tipped with an adhesive-containing capsule 14 that contains a glue-like substance 16 that adheres to a target upon impact of the projectile 10 with the target, thereby causing the projectile 10 to stick to (i.e., adhere to) the target, e.g., the target's clothing or skin. The glue-like substance 16 may be, for example, a substance marketed as STICKY FOAM, by Sandia National Laboratories of New Mexico and the adhesive-containing capsule 14 may be made from plastic, paper, acrylic-coated paper, wax or gelatin. Alternatively, the glue-like substance 16 may be a substance identified as formula #60RBGL available from Atlantic Paste and Glue, Inc. of New York. Also shown are a removable plastic cap 18, a plurality of barbed tips 20, an arming pin 22, a momentum switch 24 and an internal breakdown path 26.

The electric circuit 12 is for generating one or more high-voltage electrical pulses. A plurality of electrodes 28, 30 are coupled to the electric circuit 12 for imparting the high-voltage electrical pulses to the target, i.e., for imparting high-voltage electrical shocks to the target.

The electrodes 28, 30 of FIG. 1 comprise cylindrical contact surfaces exposed respectively at a forward end of the projectile 10, in the case of the electrode 28, and a rearward end of the projectile 10, in the case of the electrode 30. The electrodes 28, 30 may be rings that surround a projectile body 32, or alternatively disks that are interposed between portions the exterior of the projectile body 32.

The non-lethal projectile 10 of FIG. 1, has a length of for example 130 millimeters and a diameter of for example 38 millimeters. Advantageously, these dimensions permit the projectile 10 to be loaded into and fired from for example a standard M203 grenade launcher. The distance between the electrodes 28, 30 is approximately 114 millimeters, such that when the non-lethal projectile 10 strikes and adheres to the target, the electrodes 28, 30 are placed proximate enough to the target to allow the formation of an arc between the electrodes 28, 30 and the target, thereby completing an electrical circuit between the electrodes 28, 30 that includes the target.

The body 32 of the projectile 10 is in the form of a cylinder and its length is suitable for stable flight. The cylinder can be made from, e.g., plastic or resin-impregnated cardboard, for safety and cost efficiency.

The non-lethal projectile 10 also includes the removable plastic cap 18 that serves to protect the adhesive-containing capsule 14 during storage and transportation of the non-lethal projectile 10. Advantageously, the removable plastic cap 18 may be color coded to indicate, for example, a propellant load, e.g., standard for close range, or to indicate other characteristics of the present embodiment of the non-lethal projectile 10. Beneath the removable plastic cap 18, is the adhesive-containing capsule 14.

At the forward end (or front) of the projectile body 32, the adhesive is contained within a plastic or gelatin capsule 14 (the adhesive-containing capsule 14) or may simply be directly applied to the front of the projectile 10. The adhesive-containing capsule 14 contains the adhesive 16 until the projectile 10 impacts on the target, at which time the adhesive-containing capsule 14 is crushed between the target and the body 32 of the projectile 10 causing the adhesive-containing capsule 14 to rupture, and releasing the adhesive 16 onto the target. This causes the adhesive 16 to be pressed into the target, and adheres the projectile 10 to the target.

Advantageously, by containing the adhesive 16 in the adhesive-containing capsule 14, as described above, the adhesive 16 will not "gum up" mechanisms of a launch device and thereby necessitate excessive cleaning of the launch device between uses. Alternatively however, the launch device may be of a disposable nature making leakage of the adhesive during firing less problematic.

Advantageously, the adhesive-containing capsule 14 of the present embodiment is mounted on a removable cover 35 that can be removed from the non-lethal projectile 10 so as to expose the plurality of barbed tips 20. Thus, upon removal of the removable plastic cap 18, the operator of the present embodiment has the option of configuring the non-lethal projectile 10 with a front-end that presents either the adhesive-containing capsule 14, or, with the removable plastic cap removed, the barbed tips 20. Advantageously, for attachment on, for example, dry skin, clothing or leather, the operator can simply choose to present the adhesive-containing capsule 14 (by leaving the removable cover 35 in place). For attachment on, for example, wet surfaces, or thick clothing, such as leather, the operator can remove the removable cover 34, exposing the barbed tips 20. Such configuration of the projectile 10 allows for the use of the present embodiment on many different surfaces.

Alternatively, the projectile 10 may be configured to have only the adhesive-containing capsule 14 (or only the adhesive when no adhesive-containing capsule is used) or only the barbed tips 20.

Further alternatively the projectile 10 may be configured to have both the adhesive-containing capsule 14 and the barbed tips 20 positioned for simultaneous usage by placement of the adhesive-containing capsule 14 near the center of the front of the projectile 10, and placement of the barbed tips 20 at the periphery of the front of the projectile 10.

Preferably, the high-voltage electrical shocks delivered to the target are not lethal to the target, but instead disable or stun the target, or cause enough discomfort to the target, to distract the target as he/she or it attempts to dislodge the projectile 10. In any case, it is desirable that the high-voltage electrical shocks sufficiently affect the target to allow the user of the projectile 10 to subdue or bring under control the target before the effects of the high-voltage electrical shocks wear off. Preferably the voltage of the high-voltage electrical shocks is from between about 2 kV and 20 kV, e.g., about 8 kV, into a typical body impedance of 500–2000 ohms, and the current delivered by such shocks is from between about 3 A and 15 A, e.g., about 8 A. In more aggressive variations, the high-voltage electrical shocks may be made powerful enough to stun the target and to knock the target off of his/her feet, or even to render the target unconscious.

Note that it is not necessary that the electrodes 28, 30 actually contact the skin or other surface of the target for the high-voltage electrical shock to be effective. This is because the high voltage electrical shock or shocks are capable of initiating an arc in an air space of a few centimeters. Thus, so long as the electrodes 28, 30 are within a few centimeters of the skin of the target, the high-voltage electrical shock can be delivered, even through clothing.

Advantageously, the projectile 10 does not pose an undue risk to innocent bystanders as compared to conventional lethal projectiles (even if it strikes an innocent bystander directly, and delivers an electrical shock to him or her), because in the embodiments described herein the projectile 10 is designed to be non-lethal, even to the intended target. Also, material fragments, if any, from the projectile 10 are preferably not dangerous to bystanders, because such material fragments are preferably made only from paper or small bits of plastic from, for example, the body 32 of the projectile 10.

Any emitted gases resulting from the firing of the projectile 10 are preferably non-toxic in the concentrations to which bystanders may be reasonably exposed. In the present embodiment, the emitted gasses include only air, or alternatively, carbon dioxide. Black powder launch is also contemplated and the gases emitted thereby are also non-toxic in the concentrations to which bystanders may be reasonably exposed.

As mentioned above, the projectile 10 carries an electric-shock-delivering circuit 12 to provide high-voltage electrical pulses to the electrodes 28, 30 once the projectile 10 reaches the target. The projectile 10 may also carry a low-power radio receiver (not shown) capable of receiving on and off commands from, e.g., the launch device. In this way, the projectile 10 can be deactivated once sufficient stunning of the target has been achieved, so that officers can approach the target safely, without danger of they themselves being shocked, and/or can be reactivated if additional high-voltage shocks are to be delivered to the target. Furthermore, the low-power radio receiver can be used to deactivate the projectile 10 if the target stricken is not the intended target, e.g., is an innocent bystander.

As an alternative to the low-power radio receiver, the projectile 10 may include a timing circuit that deactivates the electric circuit by shunting the battery voltage after a prescribed amount of time, e.g., five to ten seconds, after the projectile 10 impacts the target (or a prescribed amount of time after the projectile is fired), so as to allow officers to safely approach the target and remove the projectile 10 after the prescribed amount of time.

The arming pin 22 protrudes from the side of the non-lethal projectile 10 near its rearward end, or alternatively may protrude from the rearward end of the non-lethal projectile 10, and serves several functions. First, the arming pin 22 (and an arming switch operated thereby) serves as a "safety switch" that prevents the momentum switch 24 from accidentally activating the projectile 10, for example, storage or handling of the projectile 10. This is accomplished in two ways: the arming pin 22 preferably serves as a mechanical barrier to closure of the momentum switch 24; and the arming pin 22 preferably electrically disconnects a battery power source from the remainder of the electric circuit 12. Furthermore, the arming pin 22 assures that the operator has made an active decision to arm the projectile 10 before the non-lethal projectile 10 is armed.

In the event the non-lethal projectile 10 is utilized in a clip-load-type of application, in which a plurality of non-lethal projectiles 10 are loaded into a clip for rapid firing, a centrifugal arming switch (not shown) may be utilized in lieu of the arming pin 22 so as to assure that the non-lethal projectile 10 is not accidentally discharged before rapid firing of the non-lethal projectile 10 is desired.

Further alternatively, in the event the projectile 10 is to be fired (i.e., launched) from a shell casing (not shown), such as could be the case if an M203 grenade launcher-type launch device is utilized, or from a barrel, a spring-loaded arming pin (not shown) can be employed that is held in place by the shell casing or barrel until the projectile 10 is fired.

Upon firing, the projectile 10 leaves the shell casing, or barrel and the spring-loaded pin is expelled from the projectile 10 by a spring (not shown). In alternative embodiments, the arming pin 22 may be incorporated into a shell casing, such that when the projectile 10 is fired from the shell, the charging circuit 64 is automatically activated.

Figure 12:
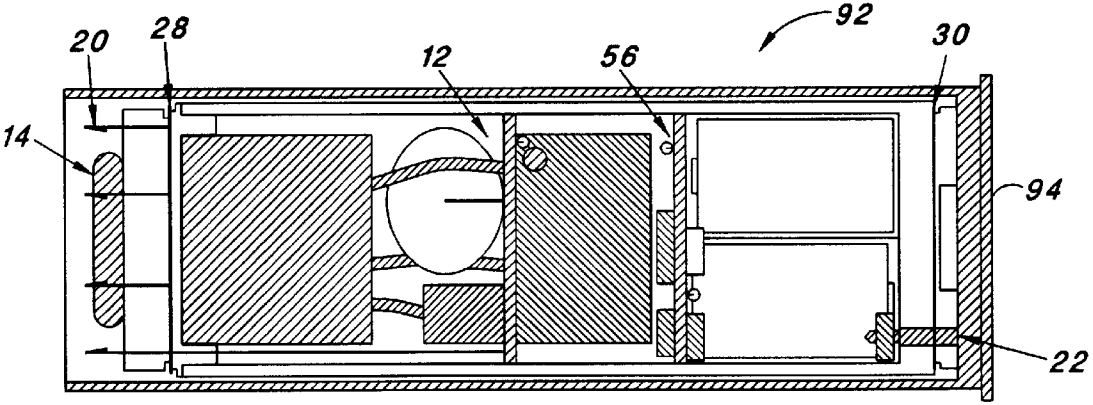
FIG. 12 is a partial side cross-sectional view of a further embodiment of the non-lethal projectile of FIG. 1 wherein a shell casing is utilized so as to enable launch of the projectile from an M203 grade launcher or other black powder or chemical launch device.

In further alternative embodiments, the arming pin may be part of a shell casing, entering the projectile 10 from its rearward end and thus allowing the projectile 10 to be armed as it is fired from the shell casing (see FIG. 12). Thus, numerous variations of the arming pin 22 are contemplated by the inventors within the scope of the invention.

A battery indication light 34 may be integrated into the rearward end of the non-lethal projectile 10 and illuminates upon removal of the arming pin 22 from the non-lethal projectile 10 so as to indicate that the non-lethal projectile 10 is armed and that the batteries located within the non-lethal projectile 10 are providing a sufficient voltage level to provide the necessary shock to the target upon impact. Alternative locations for the battery indication light 34 are envisioned, such as on the side of the projectile.

The momentum switch 24 prevents electrification of electrodes 28, 30 prior to launching of the projectile 10, or alternatively prior to impact of the projectile 10 against the target. Therefore, even with the arming pin 22 removed, the non-lethal projectile 10 can safely be handled after removal of the arming pin 22 but prior to launching of the projectile or impact of the projectile 10 against the target. The momentum switch 24 closes upon the firing of the projectile 10, or alternatively upon impact of the projectile 10 with the target. In any case, such closure of the momentum switch 24 energizes the electrical circuit 12 within the non-lethal projectile 10 and thereby presents a high voltage between the electrodes 28, 30, i.e., electrifies the electrodes 28, 30. In this way the projectile's electrodes 28, 30 are not electrified until firing of the projectile 10, or, alternatively, until the impacting of the projectile 10 against the target. An alternative projectile configuration does not have the momentum switch 24. Instead the projectile of such alternative configuration is activated as soon as its arming pin 22 is removed. Advantageously, the arming pin 22 in such configuration is part of a shell casing, and enters the projectile 10 from its rearward end so as to be removed from the projectile 10 upon its firing, thereby energizing the electrodes 28, 30 upon the firing of the projectile 10, i.e., upon the projectile leaving the shell casing (see FIG. 12).

The spark gap 26 allows current to flow through a coil in the electric circuit 12 once a capacitor voltage reaches a breakdown voltage for the spark gap 26. When current flows through the coil, and the electrodes 28, 30 are proximate enough to the target to form an arc between the electrodes 28, 30 and the target, the delivery of a high-voltage electrical shock to the target through the electrodes 28, 30 begins. Advantageously, locating the electrodes 28, 30 at each end of the non-lethal projectile 10 gives maximum electrode spacing and therefore more effective shocking of the target. The presence of the arc between the electrodes 28, 30 and the target may in some cases further increase effective electrode separation, which tends to increase the effectiveness of the present embodiment by increasing the amount of body tissue, e.g., nerve fibers, through which the high-voltage electrical shock is conducted.

A pressure chamber indent 36 may optionally be located at the rearward end of the non-lethal projectile 10 and can be used to accommodate a black powder charge blank within the launch device. (Note that if the non-lethal projectile 10 is canister loaded for black powder launch, then the battery indication light can be placed on the outside of the canister and the arming pin can be incorporated into the canister shell.)

An internal breakdown path (not shown in FIG. 1) having a breakdown voltage of about 40 kV protects the electrical circuit 12 and any other electronics within the non-lethal projectile 10 (such as a transmitter or receiver) from internal arcing in the event the electrodes 28, 30 do not make proper contact with or become proximate enough to the target for current to flow through the electrodes 28, 30 to the target.

Figure 2:
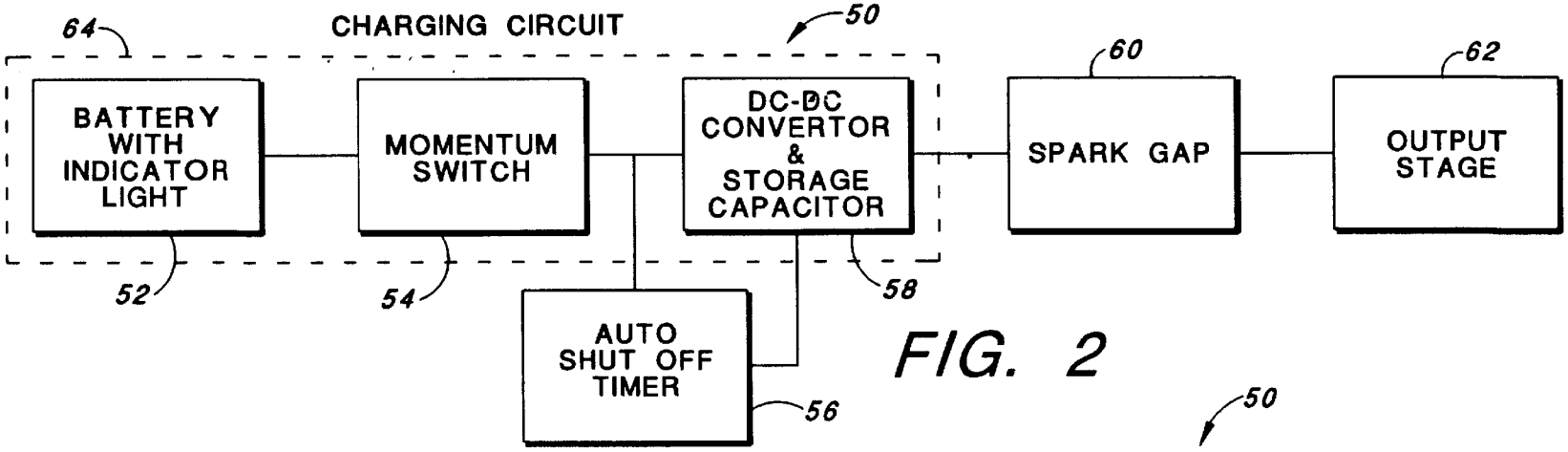
FIG. 2 is a block diagram of one embodiment of an electric-shock-delivering circuit useable in the non-lethal projectile embodiment of FIG. 1.

Referring to FIG. 2, a block diagram is shown of one embodiment of the electric-shock-delivering circuit 50. Shown are a battery and an indicator light 52, a momentum switch 54, an auto shut-off timer 56, a DC-to-DC converter and storage capacitor 58, a spark gap 60, and an output stage 62. A charging circuit 64 is made up of the battery and indicator light 52, the momentum switch 56, and the DC-to-DC converter and storage capacitor 58. Within the charging circuit 50, the battery and indicator light 52 are coupled to the momentum switch 54. In turn, the momentum switch 54 is coupled to the DC-to-DC converter and storage capacitor 58. Also coupled to the DC-to-DC converter and storage capacitor 58 is the auto shut-off timer 56, which is also coupled to the momentum switch 54. The spark gap 60 is coupled to the DC-to-DC converter and storage capacitor 60, and the output stage 62 is coupled to the spark gap 60.

The internal electronic components of the projectile 10 are mounted to a printed circuit board, with the output transformer overhanging the printed circuit board so as to provide the spark gap 60 for internal breakdown between the printed circuit board ground plane and a pin attached to a distal lead of the primary coil of the output transformer. One of the secondary coil electrodes of the output transformer is coupled to one of the electrodes 28, 30, i.e., one of the two exposed electrodes 28, 30 used to shock the target. The remaining primary and secondary coil of electrodes of the output transformer are coupled to the ground plane of the circuit board.

The battery is comprised, for example, of five AAAA cells, which together produce the 7.5 volt output.

The momentum switch 54 is constructed from a miniature toggle switch to which a brass ball is glued at the toggle arm. When the projectile 10 impacts on the target, the momentum of the brass balls throws the toggle arm, thus closing the momentum switch 56 and activating the charging circuit 64. The auto shut-off timer 56 deactivates the charging circuit 64 after the prescribed amount of time, which is preferably about 10 seconds. Advantageously, the momentum switch 54 is positioned such that insertion of the arming pin 22 (FIG. 1) in the arming switch not only opens the arming switch, but also moves the toggle arm of the momentum switch 54 into an open position.

Figure 3:
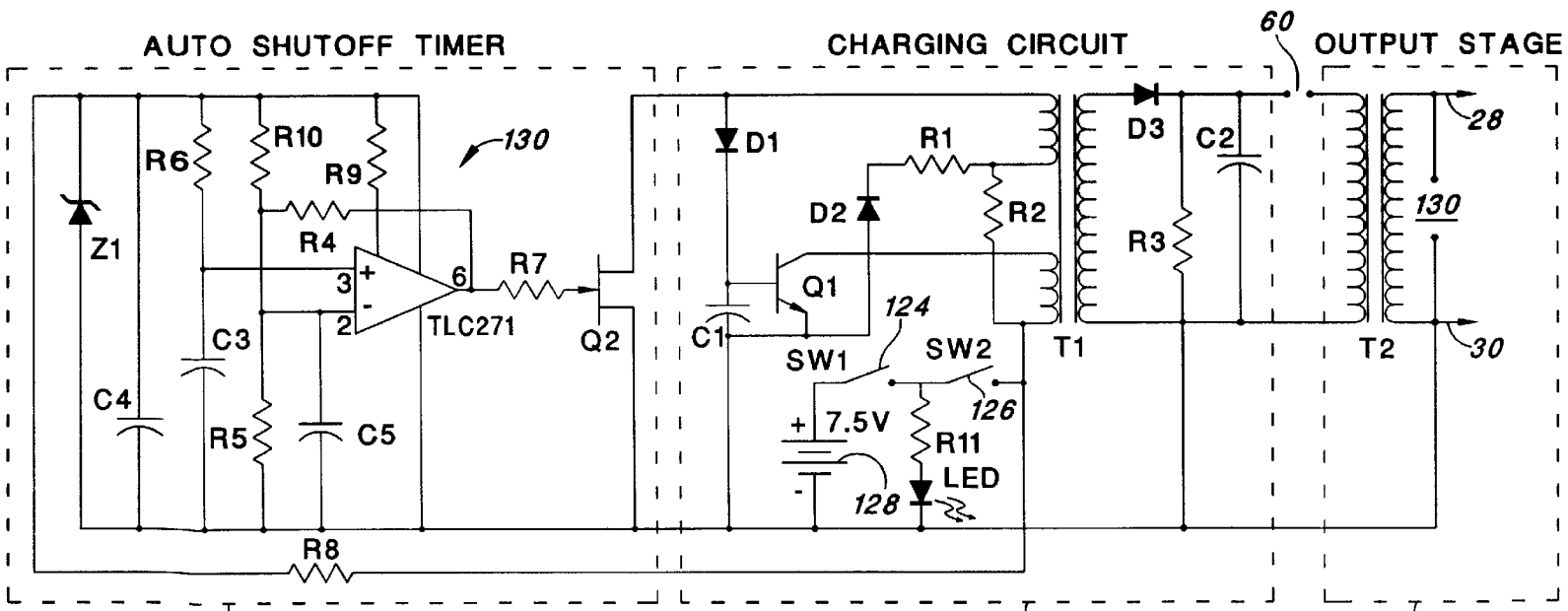
FIG. 3 is a schematic diagram of the one embodiment of the electric-shock-delivering circuit of FIG. 2.

Referring next to FIG. 3, a schematic diagram is shown of the one embodiment of the electric circuit 50. Shown are the pair of electrodes 28, 30, the arming switch 124 associated with the arming pin 22, the momentum switch 126, the battery 128, the internal spark gap 130, the spark gap 60, and various other components of the non-lethal projectile 10 such as the auto shutoff timer 56 (R/C timing circuit) the charging circuit 64 and the output stage 62.

When the projectile 10 impacts against the target, the momentum switch 54 is closed, thereby applying power from the battery, which may have a voltage of from between about 6 volts and 9 volts, e.g., 7.5 volts, such as from two or three 3-volt lithium cells or from to six AAAA alkaline cells, simultaneously to the charging circuit 64 and the auto shut-off timer 56. The DC-to-DC converter and storage capacitor 58 use an oscillator made up of a self-blocking transformer, a power transistor, and various passive components, to produce voltage pulses across secondary coils of the transformer at a rate of about 11 kHz. A diode is used to assure that these pulses slowly add charge to an energy storage capacitor. When the voltage across the energy storage capacitor reaches a breakdown voltage of the spark gap 60, which is about 1300 volts, the charge on the energy storage capacitor is dumped through a primary coil of an output transformer within the output stage 62 at a peak current of 300 amps. The turns ratio of the output transformer is 60:1, thus producing a theoretical open circuit voltage of about 80 kilovolts. In practice, however, an arc will be generated at lower voltages either across an internal spark gap (i.e., safety spark gap) or preferably into the target. Peak current in such arc is about 5 amps. The oscillator circuit continually charges the storage capacitor, producing repetitive discharges at a rate of about 5 to 6 hertz, which is lower than in commercially available stun guns (since a 7.5 volt battery is used in the present embodiment instead of a more typical 9 volt battery.) During the continuous charging of the storage capacitor, and periodic discharging of the storage capacitor into the target, a timing capacitor in the auto shut-off timer 56 is slowly charging. When the voltage across such timing capacitor exceeds a threshold voltage, the oscillator circuit is disabled thus stopping the charging of the storage capacitor.

As remaining features of this diagram are self-explanatory and will be apparent to the skilled artisan, further explanation of the structure represented and its functionality is not made herein.

Figure 4:
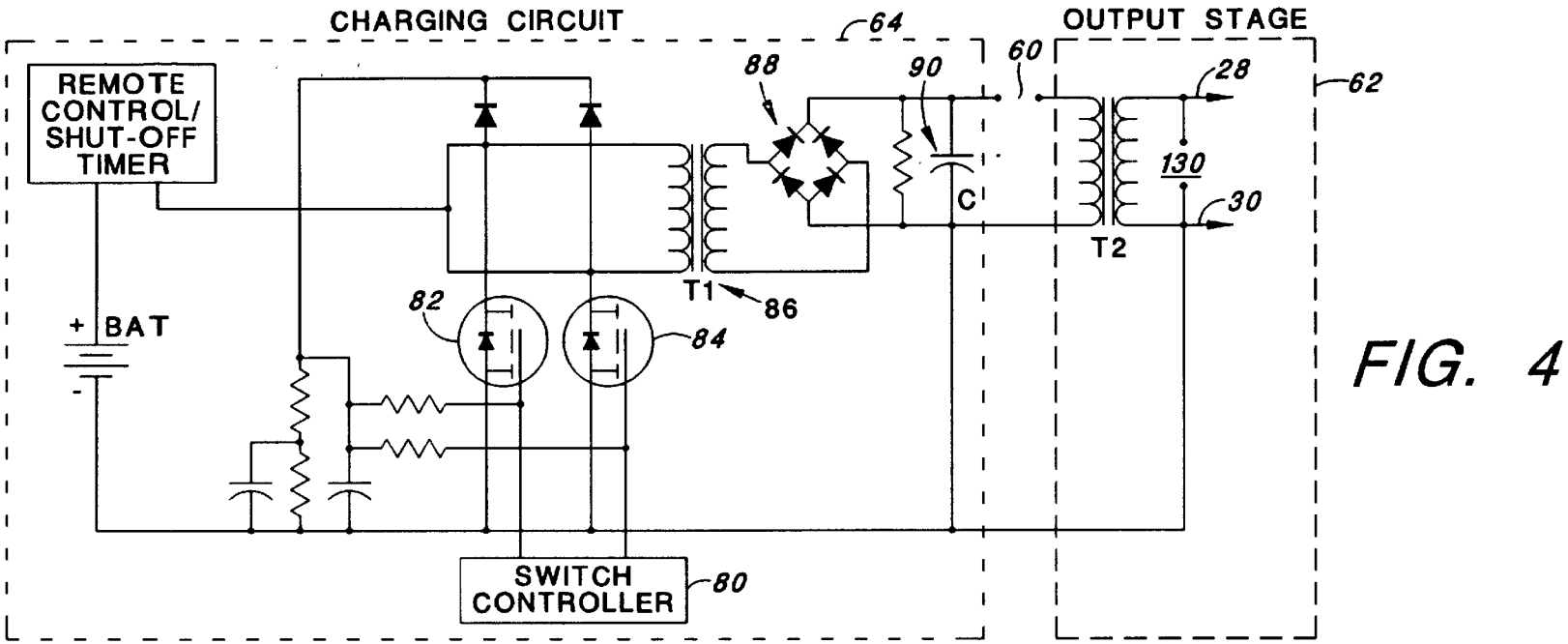
FIG. 4 is a schematic diagram of variation the voltage—set-up circuit FIG. 6 employing a pair of switching transistors that are turned on using a switching controller that activates the switching transistors using respective switching signals that are 180° out of phase from one another, and wherein a full wave rectifier is also employed so as to increase charging efficiency.

Referring to FIG. 4, a schematic diagram is shown of a variation of the above-described voltage-step-up 50 circuit that is part of the one variation of the electric-shock-delivery circuit 12. The charging circuit 64 uses a switch controller 80 to activate two switching transistors 82, 84 using signals that are 180° out of phase with one another, thereby driving a transformer 86 with alternating pulses. An oscillating output of the transformer 86 is coupled to a full wave rectifier 88, such that both polarities to charge a storage capacitor 90, thereby increasing efficiency. When a voltage on the storage capacitor 90 reaches a breakdown voltage for the spark gap 60, the energy stored in the storage capacitor 90 discharges through a primary coil of an output coil in the output stage 62, thus producing a high voltage pulse at the electrodes 28, 30. The entire voltage-step-up circuit 50 is controlled by a switch in series with a battery power source. The switch is controlled by an auto shut-off timer and/or a remote control, such as are both described in this patent document.

Figure 5:
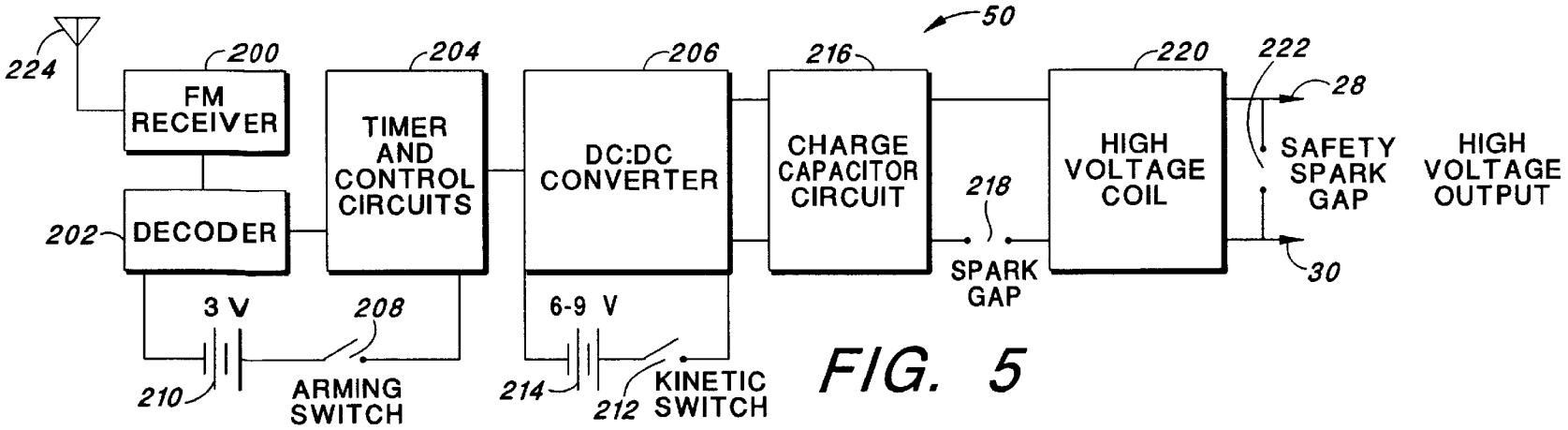
FIG. 5 is a block diagram of another embodiment of the electric-shock-delivering circuit useable in the non-lethal projectile embodiment of FIG. 1.

Referring to FIG. 5, a block diagram is shown of another embodiment of the electric-shock-delivering circuit 50. Shown are an FM receiver 200, a decoder 202, timer and control circuits 204, a DC-to-DC converter 206, an arming switch 208, a control circuit battery 210, a momentum switch 212, a charging battery 214, a charge capacitor circuit 216, a spark gap 218, a high voltage coil 220, an internal spark gap 222, and the electrodes 28, 30.

The FM receiver 200, which includes an antenna 224, is coupled to the decoder 202, which is in turn coupled to the timer and control circuits 204. The arming switch 208 and the control circuit battery 210, which is a 3 volt lithium battery, are coupled in series with the decoder 202 and timer and control circuits 20. The timer and control circuits 204 are coupled to the DC-to-DC converter 206, which is coupled in series with the charging battery 214, which is a 7.5 volt battery, and the momentum switch 212. The DC-to-DC converter 206 is also coupled to the charge capacitor circuit 216, which in turn is coupled in series with the high voltage coil 220 and spark gap 218. The high voltage coil 220 is coupled in parallel with the internal spark gap 222 and the electrodes 28, 30.

The timer and control circuits 204 are used to sense an output from the decoder 202 and to initiate a repeat firing of the DC-to-DC converter 206. In addition, an 8 to 10 second, timer that is part of the timer and control circuits 204 is initiated upon the closing of the momentum switch 212 at impact of the projectile 10 against the target. The timer and control circuits 204, along with the decoder 202 and FM receiver 200, are powered by the control circuit battery 210, e.g., a 3-volt lithium battery.

A learning sequence is required for the decoder circuit 202. This learning sequence can be delivered to the projectile 10 during flight, which insures that only projectiles that have been launched are armed and capable of delivering a shock to a target. Alternatively, the decoder learning sequence can be initiated when the projectile 10 is loaded into the launch device.

The DC-to-DC converter 206 is used to convert the charging battery 214, voltage, which may be, for example, 7.5 Volts, into an approximately 1600 to 1700 Volt voltage. The DC-to-DC converter is made up of an oscillator used to drive a MOSFET transistor at 20 kHz. The MOSFET switches on and off and is in series with the charging battery and a primary coil of a transformer within the DC-to-DC converter 206. A timer oscillator, such as a 555C integrated circuit timer oscillator, is used as the oscillator.

Approximately 8 pulse Amperes are drawn from the charging battery 214 (7.5 Volt battery). In order to provide this level of current, two 7.5 Volt batteries are preferably connected in parallel. Alternatively, some commercially available lithium manganese dioxide batteries are capable of providing this level of current at about 6 Volts.

Figure 6:
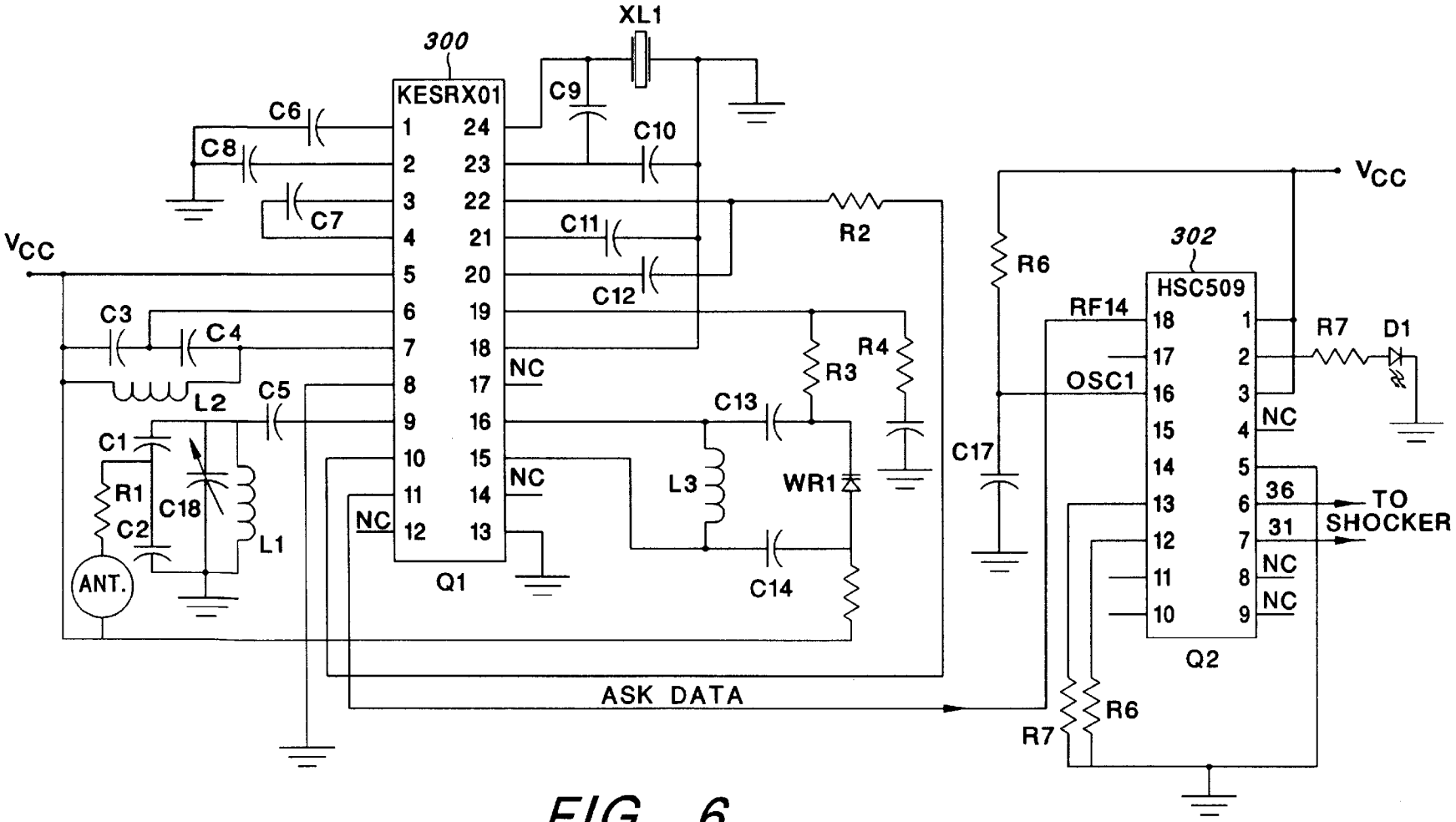
FIG. 6 is a schematic diagram of a receiver and a decoder that are part of one variation of the electric-shock-delivering circuit of FIG. 5.

Referring to FIG. 6 a schematic diagram is shown of receiver 300 and a decoder 302 that are part of one variation of the electric-shock-delivering circuit 12. The receiver 300 is, for example, preferably a GEC Plessy Semiconductor KEREX01, 290 to 460 MHz Amplitude Shift Key (ASK) receiver chip, which is a companion chip for a GEC Plessy Semiconductor KESTX01 transmitter chip. The KEREX01 chip's architecture is that of a single conversion superhetrodyne receiver. Local oscillator functionality is performed by a phase lock loop that utilizes a crystal reference oscillator.

The decoder 302 is a Microchip Technology Incorporated HCS509 code hopping decoder designed for secure remote keyless entry (RKE) systems. The decoder 302 uses a code hopping system and high security learning mechanism marketed under the trade name KEELOQ, which is known in the art and readily available. A manufacturers key, transmitter keys and synchronization information are stored in a protected on chip EEPROM within the decoder 302.

As the remainder of this diagram is self-explanatory to the skilled artisan, further explanation of the structure represented and its functionality is not made herein.

Figure 7:
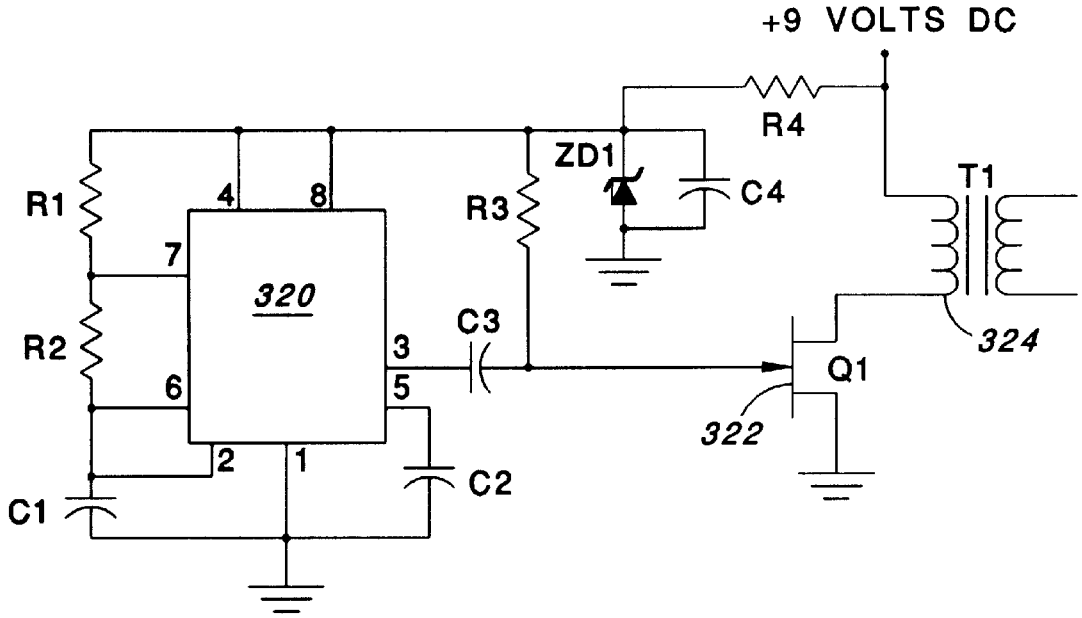
FIG. 7 is a schematic diagram of a voltage-step-up circuit that is part of a variation of the electric-shock-delivering circuit of FIG. 5.

Referring to FIG. 7 a schematic diagram is shown of a voltage-step-up circuit that is part of the one variation of the electric-shock-delivering circuit 12. Shown is an oscillator 320, and a MOSFET 322. The MOSFET 322 is driven on and off by the oscillator 320 in order to provide pulses of current through a transformer 324. The oscillator 320 is preferably a 555C timer/oscillator. Further explanation of the voltage-step-up circuit is made hereinabove in reference to FIG. 5. FIG. 7 should be self-explanatory to the skilled artisan, and therefore further explanation of the structure represented and its functionality is not made herein.

Figure 8:
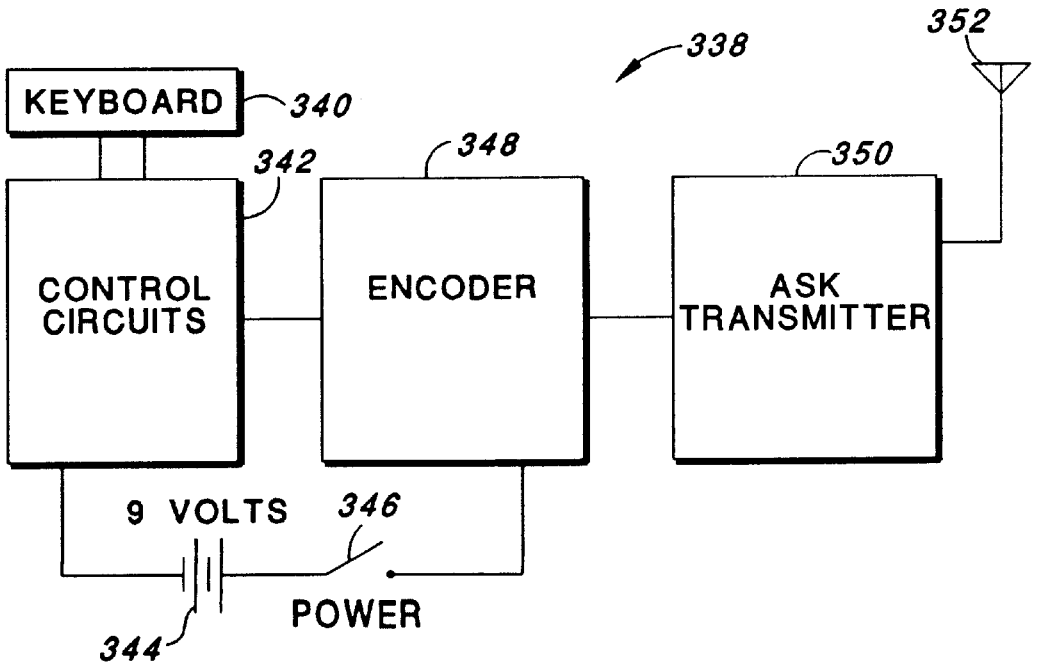
FIG. 8 is a block diagram of a remote control system useable with the electric-shock-delivering circuit of FIG. 5.

FIG. 8 is a block diagram of a remote control system 338 useable with the electric-shock-delivering circuit.. Shown is a keyboard 340 and a control circuit 342, a 9 volt battery 344, a power switch 346, an encoder 348, and an Amplitude Shift Key (ASK) transmitter 350 and antenna 352.

The keyboard 340 is coupled to the control circuits 342, which are coupled in series with the encoder 348, the power switch 344, 346 and the 9 volt battery 344. The encoder is in turn coupled to the ASK transmitter 350.

The remote control system 338 is used, in practice, to remotely activate and deactivate the electric circuit within one or more projectiles having been fired. The encoder 348 encodes control signals from the control circuits 342 and passes them to the ASK transmitter 350 for transmission through the antenna 352 to, for example, the antenna 224 (FIG. 5) of the FM receiver 200 (FIG. 5) described hereinabove.

The encoder 348 is preferably a code-hopping encoder such as the HCS300 from Microchip Technology Incorporated designed for secure keyless entry (RKE) systems. The HCS300 utilizes KEELOQ code-hopping technology, which provides high security small package outline and low cost.

The ASK transmitter 350 may be a single chip ASK transmitter such as the KESTX01 from GEC Plessy Semiconductors. This single chip ASK transmitter has been developed GEC Plessy Semiconductors specifically for low power radio applications, including keyless entry, general domestic and industrial remote control, RF tagging and local paging systems. However, numerous alternative transmitters are readily available in the commercial marketplace that are suitable for use with the present embodiment.

Figure 9:
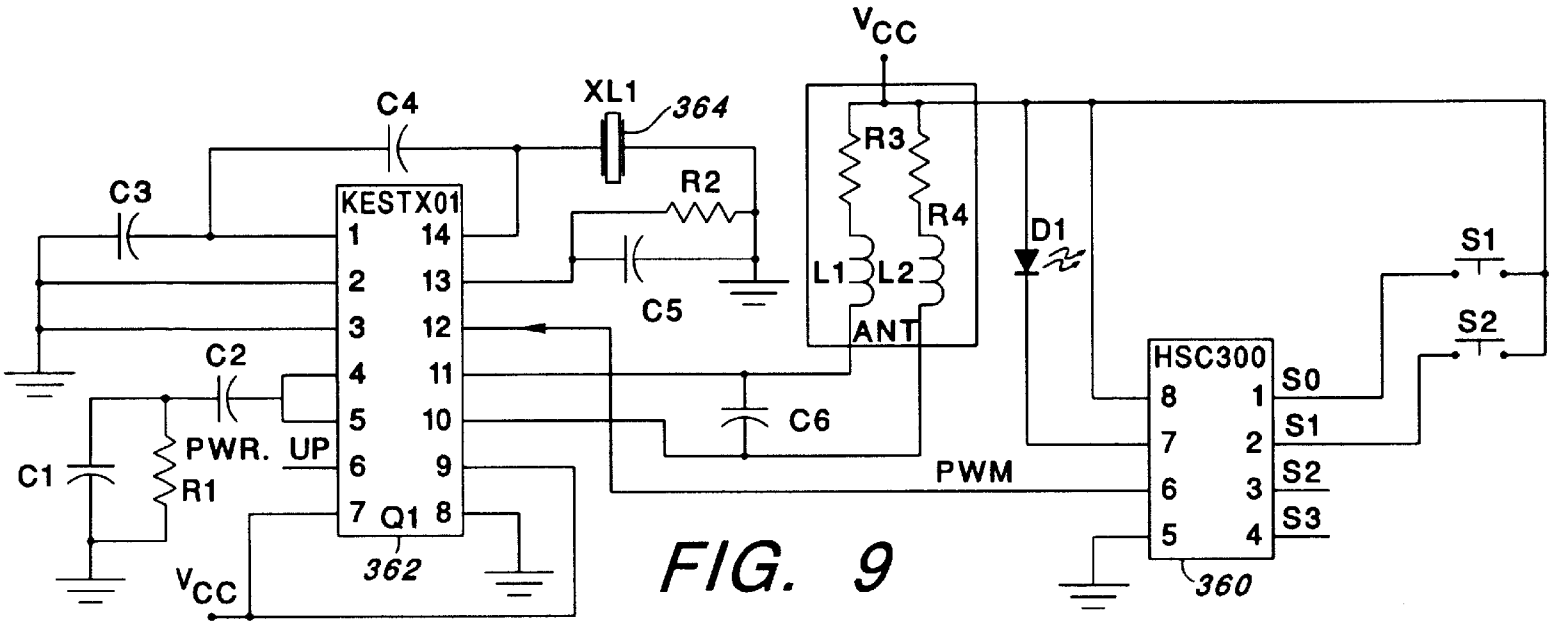
FIG. 9 is a schematic diagram of a transmitter and encoder that are part of one variation of the remote control system of FIG. 8.

FIG. 9 is a schematic diagram of a transmitter and encoder that are part of one variation of the remote control system 338. The encoder 360 and the transmitter 362 are shown. A transmitter frequency is controlled by a crystal oscillator 364, which is coupled to the transmitter 362. Additional components and the connections therebetween and the functionality of such components are self-explanatory to the skilled artisan and therefore, further explanation of the structure represented and its functionality is not made herein.

Figure 10:
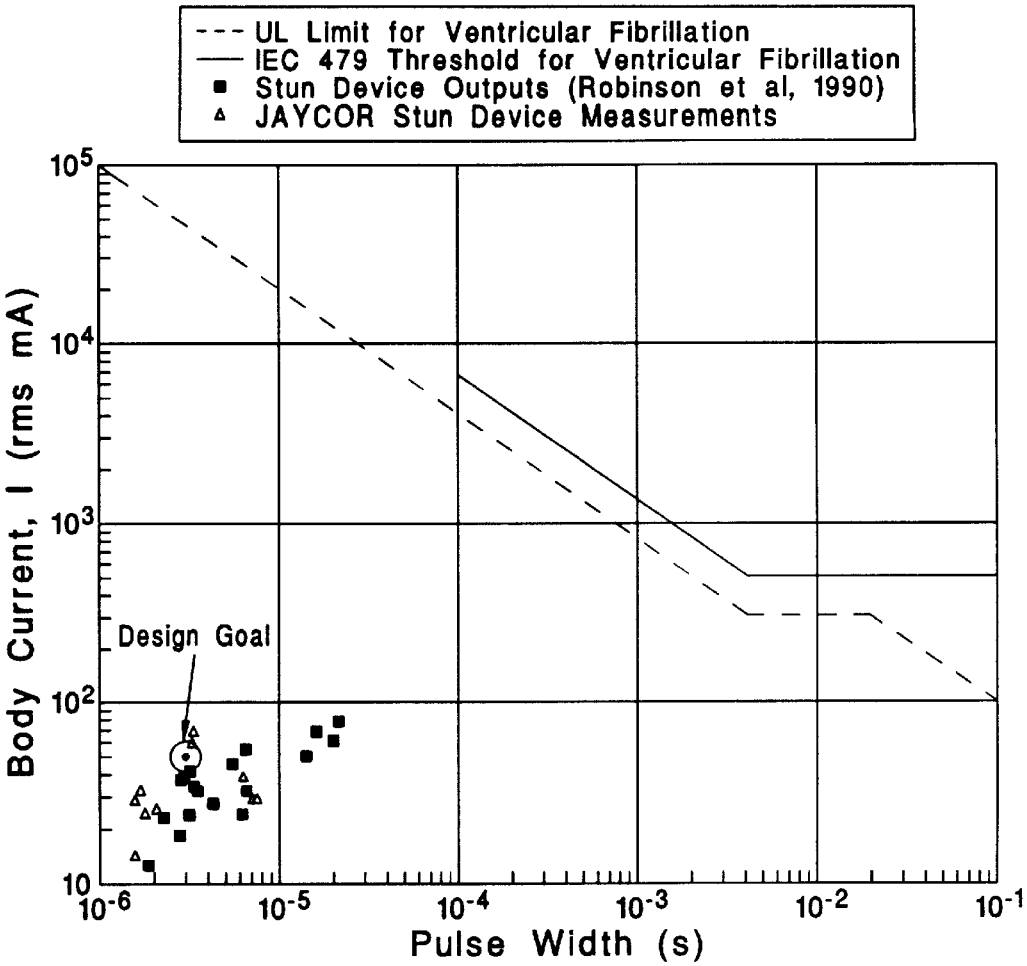
FIG. 10 is a graphical representation of a body current verses pulse width threshold above which the electric-shock-delivering circuit preferably does not operate, and exemplary datum points indicating the body current and pulse width typically achieved with the electric-shock-delivering circuit of FIG. 5.

FIG. 10 is a graphical representation of a body current verses pulse width threshold, above which the electric-shock-delivering circuit 12 preferably does not operate, and exemplary datum points indicating the body current and pulse width typically achieved with the electric-shock-delivering circuit 12 of the embodiments described herein and with an exemplary stun gun-type device. Body current is represented on a vertical axis (as oriented in FIG. 10) and is given on a logarithmic scale in RMS milliamps. Pulse width is represented on a horizontal axis and is given on a logarithmic scale in seconds. A dotted line represents an Underwriters Laboratories body current/pulse width limit for ventricular fibrillation and a solid line represents an IEC479 body current/pulse width threshold for ventricular fibrillation. Body current vs. pulse width measurements for an exemplary stun gun device, such as those commonly known in the art, are represented using small solid squares, whereas exemplary body current vs. pulse width measurements for the embodiments disclosed herein are shown using small open triangles.

Figure 11:
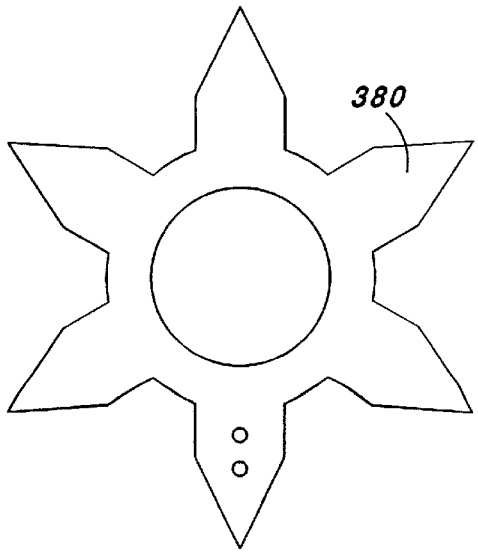
FIG. 11 is an axial view of an alternative variation of an electrode useable in the embodiment of FIG. 1 in lieu of the pair of metallic bands shown.

FIG. 11 is an axial view of an alternative variation of an electrode useable in lieu of the metallic band electrodes 28, 30 used in the above-described embodiment of the projectile 10. The alternative variation employs a chemically etched 0.020 inch brass star-shaped electrode 380. Advantageously such star-shaped electrode 380 performs functions similar to those described above with respect to the band electrodes, 28, 30 while eliminating a significant amount of metal, thereby reducing the weight of the projectile 10. At the same time however, the shock delivering capabilities of the star-shaped electrode 380 are similar to those of the metallic band electrodes 28, 30 described above.

Referring next to FIG. 12, a partial side cross-sectional view is shown of a further embodiment of the non-lethal projectile 92. The projectile 92 of FIG. 12 employs a shall casing 94 into which the arming pin 22 has been integrated so as to be withdrawn from the arming switch upon the launching of the projectile 92, i.e., when the projectile 92 leaves the shell casing 94. In addition, the projectile 92 configured to present both the adhesive-containing capsule 14 and the barbed tips 20 when the projectile 92 impacts against the target. Further, the projectile 92 employs a pair of CR2 batteries, instead of the 4 to 6 AAAA cells of the embodiments depicted above. The charging circuit 12 and the control circuit, e.g., the auto-shut-off timer 56, are positioned on disk-shaped printed circuit boards in order to better utilize space within the projectile 92. The momentum switch (described above) has been omitted from the projectile 92 shown in order to save space, reduce weight, and because its functionality is at least in part performed by the arming pin 22 in the present embodiment. Except for those differences noted above, however, the projectile 92 of FIG. 12 is substantially the same as the projectile 10 of FIG. 1, and therefore further explanation of the present embodiment is not made herein.

Figure 13:
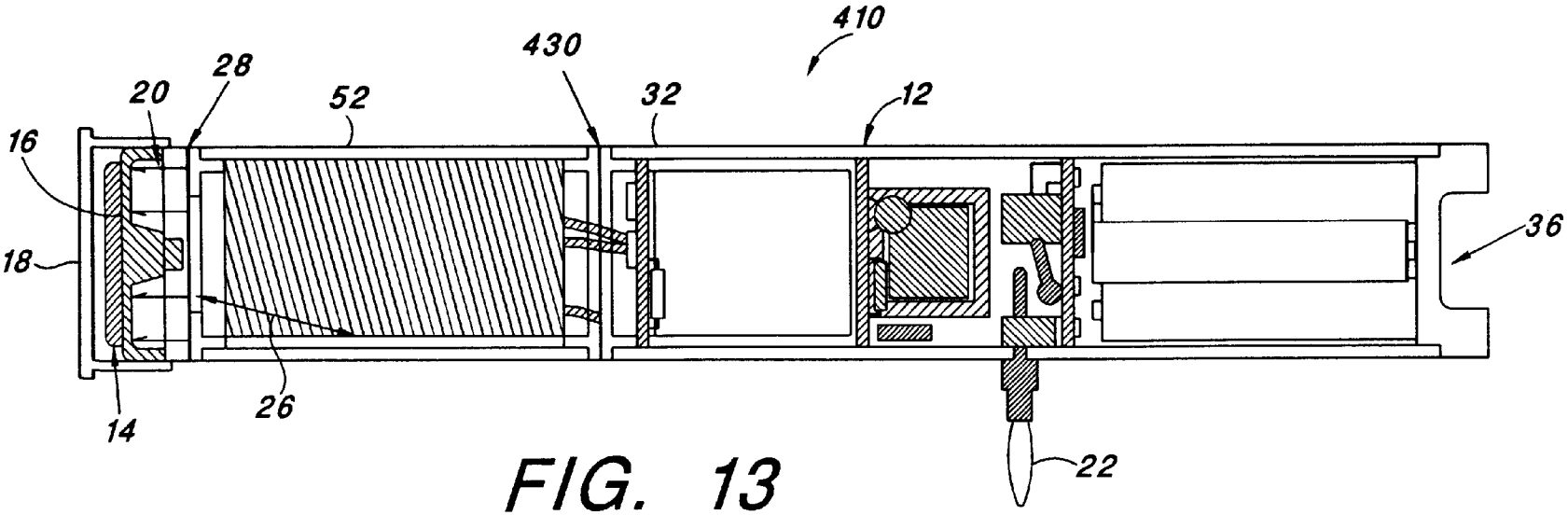
FIG. 13 is a partial side cross-sectional view of an additional embodiment of the non-lethal projectile of FIG. 1 wherein components thereof are selected and arranged for a smaller diameter non-lethal projectile to allow launch of the non-lethal projectile from a smaller diameter launch device, and wherein the electrodes may be located respectively at the forward end of the non-lethal projectile and at a central region of the non-lethal projectile.

FIG. 13 is a partial side cross-sectional view of an additional embodiment of the non-lethal projectile 410 wherein the electrodes 28, 430 comprise a pair of metallic bands located respectively at the forward end and at a central region of the projectile 410. The embodiment of FIG. 13 has a length of 178 millimeters and a diameter of approximately one inch (approximately 25.4 millimeters). Advantageously, such configuration allows the launching of the non-lethal projectile 410 of FIG. 13 from small covert launch devices such as flashlights or PR24 batons. The electrodes 28, 430 are placed at the forward end of the non-lethal projectile 410, in the case of the electrode 28, and slightly forward of the center of the non-lethal projectile 410, in the case of the electrode 430. In other words, the electrode 30 (of FIG. 1) has been moved forward (in FIG. 13) relative to its position in the embodiment of FIG. 1, which movement is needed as a result of the added length in the embodiment of FIG. 13 relative to the length of the embodiment of FIG. 1 in order to assure that arcing will occur between the electrodes 28, 430 and that shocking of the target will occur. In variations of all of the embodiments of the projectile described herein, deployable rear electrodes may be employed using, for example, any of the deployment methodologies described herein.

Additional features that may be utilized in combination with, or instead of, the features of the embodiments shown in FIGS. 1 and 11 include features such as injection molded body members and a small high ampere-hour battery pack (which allows for further reduction in both size and weight of the non-lethal projectile 10 or 410).

Figure 14:
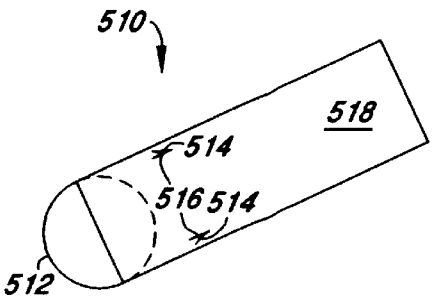
FIG. 14 is a side view of an alternative embodiment of the non-lethal projectile of FIG. 1 for delivery of the electric-shock-delivering circuit to a target wherein a plurality of needle-like electrodes are deployable through peripheral openings near the forward end of the non-lethal projectile.

Referring to FIG. 14, a side-view is shown of one embodiment of the non-lethal projectile 510 for delivering the electric-shock-delivering circuit to a target. The projectile 510 is blunt and tipped with the adhesive-containing capsule 512 that contains the glue-like substance that adheres to the target upon impact of the projectile 510 with the target, thereby causing the projectile 510 to stick to the target. As with the embodiment of FIG. 1, the glue-like substance may be, for example, the substance marketed as STICKY FOAM, by Sandia National Laboratories of New Mexico and the adhesive-containing capsule 512 may be made from plastic, wax, paper, acrylic-coated paper or gelatin. Alternatively, the glue-like substance may be a substance identified as formula #60RBGL available from Atlantic Paste and Glue, Inc. of New York. Further alternatively, the glue-like substance may be merely applied to the forward end of the projectile, instead of being contained in the adhesive-containing capsule 512. Advantageously, this latter approach may result in a cost reduction, but may make the projectile more difficult to handle and/or the glue-like substance more likely to gum up the launch device.

In other possible embodiments, the adhesive can be contained within a hard capsule that shatters upon impact, such as a capsule made from plastic or pill gel, or the adhesive may be ejected through one or more openings near the front end of the capsule during or prior to the firing of the projectile.

The projectile 510 also includes the electric-shock-delivering circuit (electric circuit) for generating one or more high-voltage electrical pulses, and a plurality of electrodes 514 for imparting such high-voltage electrical pulses to the target. The electrodes 514, as shown, are retracted within the projectile 510, with only their tips projecting through openings 516 in the periphery of the projectile 510 near its forward end, as would be the case before the projectile 510 is fired, and before the projectile 510 impacts on the target.

In operation, the electrodes 514 deploy upon impact of the projectile 510 with the target to a point close enough to a skin surface of the target so that an electrical shock is imparted to the target when the electrical pulse or pulses are generated.

Note that as with the embodiments described above it is not necessary that the electrodes 514 actually contact the skin or other surface of the target for the electrical shock to be imparted and effective. This is because 50 to 100 kV (open circuit) electrical pulse or pulses generated by the electric circuit are capable of initiating an arc in an air space of a few centimeters. Thus, so long as the electrodes 514 are within a few centimeters of the skin of the target, the electrical shock can be delivered even through clothing, including leather clothing.

In situations where the target may be wearing, e.g., heavy leather clothing through which neither the electrodes 514 nor the electrical pulses can effectively deliver an electrical shock, such target may still be vulnerable on areas that are not covered by the heavy leather clothing.

It is recognized, however, that projectiles of the present embodiment when designed for a target wearing typical clothing may be less effective against a target wearing thick clothing, such as a thick leather jacket, than against a target wearing thinner clothing or against bare skin. This is because neither the electrodes 514 nor the arc emanating therefrom may be able to penetrate such thick clothing. In order to address this problem, one possible approach is to construct specially-designed projectiles for use against heavily-clothed targets. Such projectiles may have elongated electrodes that extend, e.g., from between 0.5 and 3 cm, e.g., 1 cm, in front of the projectile. In variations of the embodiments described herein, the electrodes may extend by those amounts behind the projectile as well as or instead of extending in front of the projectile.

The battery component of the electrical circuit is preferably a 6-Volt to 9-Volt battery, such as from two to three 3-Volt lithium cells or four to six 1.5-Volt AAAA alkaline cells.

As with the above-described embodiments, the body 518 of the projectile is in the form of a cylinder that has a length suitable for stable flight. The projectile body 518 is preferably made from a light weight material, such as plastic, for safety and cost efficiency.

Simultaneously, with the rupturing of the adhesive-containing capsule 512, a switch or electrode trigger located behind the adhesive-containing capsule is actuated by the compression of the adhesive-containing capsule 512 toward the rearward end of the projectile 510. The electrode trigger releases a spring in a spring-loaded locking mechanism, causing the spring to force the electrodes 514, which may be four in number, to spring out through the openings 516 toward the target. Before the projectile 510 is fired, the spring is held in a compressed state by a locking mechanism, which may be of conventional design. The locking mechanism is coupled to the electrode trigger, and upon compression of the electrode trigger, which occurs upon impact of the projectile 510 against the target, the locking mechanism releases the spring, thereby deploying the electrodes 514 out through the peripheral openings 516 and toward the target.

In the present embodiment, there are four needle-like electrodes 514 spaced around the circumference of the forward end (or front) of the projectile body 518 at 90° intervals. Two electrodes 514, at 180° orientation with respect to each other, are electrically coupled together, having the same "polarity". The other two electrodes 514 (also at 180° orientation to each other) are also electrically connected having a "polarity" opposite from the first two electrodes 514. Such arrangement of the electrodes 514 increases the probability that a pair of electrodes 514 having opposite "polarity" will contact or come close enough to contacting the target once the projectile impacts the target to provide an electrical path through the target between the electrodes 514.

The needle-like shape of the electrodes 514 of the present embodiment serves two primary purposes. First, the needle-like shape helps to entangle the projectile in, e.g., the clothing of the target, thus reducing the probability that the projectile will glance off of the target before the adhesive has a chance to cure and adhere to the target. Second, the needle-like shape tends to cause the electrodes 514 to penetrate, e.g., the clothing of the target, thus decreasing the distance between the electrode 514 and the target's body, and thereby increasing the probability of an arc occurring.

For most applications, the length of the electrodes 514 in front of the projectile body (after deployment) is relatively short, e.g., from between 0.5 and 1.0 cm, e.g., 0.8 cm. Thus, if one or more of the electrodes 514 do penetrate the target, it can be readily extracted. The electrodes of the present embodiment are preferably barbless, unlike the barbed electrodes of a taser gun, or in some variations may be barbed like the barbed electrodes of a taser gun for better attachment to the target. When barbless electrodes are used, extraction of the electrodes 514 from the target after the target is subdued can better be achieved without physical damage to the target.

As mentioned above, the projectile 510 carries an electrical circuit, including a battery, to provide high-voltage electrical pulses to the electrodes 514 once the projectile 510 reaches the target. The projectile 510 may also carry a low-power radio receiver (not shown) capable of receiving on and off commands from a transmitter in, e.g., the launch device. In this way, the projectile 510 can be deactivated once sufficient stunning of the target has been achieved, so that officers can approach the target safely, or reactivated if sufficient stunning has not occurred within an automatic timeout period. Furthermore, the low-power radio receiver can be used to deactivate the projectile 510 if the target stricken is not the intended target, e.g., is an innocent bystander. The projectile also or alternatively includes timing circuit that deactivates the electric circuit a prescribed amount of time after the projectile 510 impacts the target (i.e., after the expiration of the automatic timeout period), so as to allow officers to approach the target safely after the automatic timeout period has expired.

Figure 15:
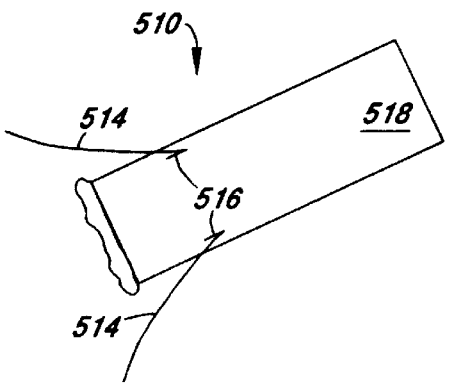
FIG. 15 is a side view of the embodiment of the non-lethal projectile of FIG. 14, wherein the plurality of needle-like electrodes are deployed through the peripheral openings of the non-lethal projectile.

Referring next to FIG. 15, a side view is shown of the non-lethal projectile 510 wherein the plurality of electrodes 514 are deployed, and the adhesive-containing capsule 512 is ruptured as would be the case after the projectile 550 strikes a target. As best shown in FIG. 15, the probability of the projectile 510 glancing off of the target is preferably minimized by having the electrodes 514, when deployed, protrude a short distance in front of the projectile 510 so that they can snag on, e.g., the clothing of the target, and thereby stop or slow the motion of the projectile 510.

In order to increase the distance between the electrode tips, thus maximizing the potential arc gap and therefore the effectiveness of the shocks delivered, the spring loaded locking mechanism is employed to deploy the electrodes 514 on impact. The spring-loaded locking mechanism is designed to withstand the firing of the projectile 510, and to trigger upon impact of the projectile with the target. As mentioned above, upon triggering, the electrodes 514 are deployed by the spring-loaded locking mechanism toward the target through the openings 516 in the periphery of the projectile 510, more specifically openings 516 in the projectile body 518 at its forward end. The electrodes 514, once deployed, are properly spaced for delivering an electrical shock, i.e., are at the proper arc gap.

Figure 16:
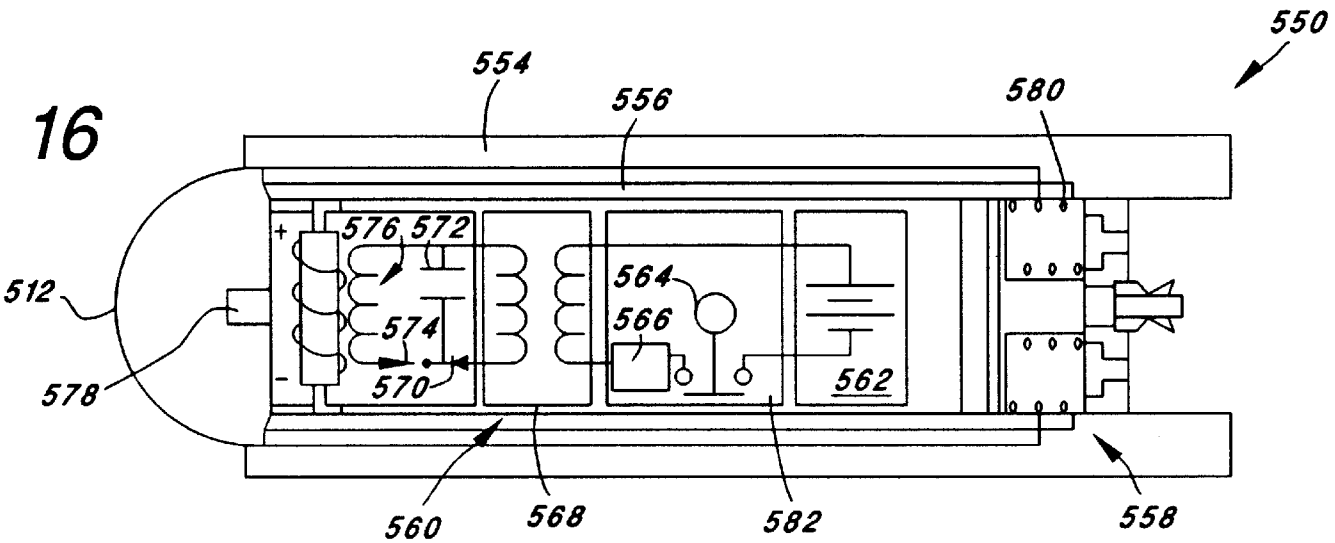
FIG. 16 is a side cross-sectional view of another embodiment of the non-lethal projectile of FIG. 1, wherein needle-like electrodes are fashioned so as to be deployed through an adhesive-containing capsule.

Referring next to FIG. 16, a partial side cross-sectional view is shown of a further embodiment of a non-lethal projectile 550 for delivering an electric-shock-delivering circuit to a target. Many aspects of the embodiment of the projectile shown in FIG. 16 are substantially identical to the embodiment of FIG. 14, and therefore explanation of such aspects of such embodiment is not repeated below.

The electric circuit 560 includes the battery 562, a transceiver or receiver 564, a chopper 566, a step-up transformer 568, a diode 570, a capacitor 572, a spark-gap 574, and a high-voltage coil pair 576. The spring-loaded locking mechanism 558 includes the electrode trigger 578 and the spring 580.

Unlike the electrodes 514 described above with reference to FIGS. 12 and 13, the electrodes 556 of FIGS. 14 and 15 deploy, not through the openings 516 (as is the case with the embodiment described in reference to FIGS. 12 and 13), but through the adhesive-containing capsule 512 itself. Such arrangement not only helps to position the electrodes 556 to better engage the target, for example, by snagging his/her clothing, but also serves to help rupture the adhesive-containing capsule 512 upon impact. As a result, the adhesive-containing capsule 512 of the embodiment of FIGS. 14 and 15 can be made of a slightly stronger composition, e.g., may be thicker, than the adhesive-containing capsule 512 of the embodiment described in reference to FIGS. 12 and 13.

Also shown in FIG. 16 is the electric circuit 560. (The electric circuit of FIG. 16 is similar to the electric circuit of FIGS. 12 and 13, and is described hereinbelow in greater detail than above.) Within the electric circuit 560, the battery 562 is coupled in series with the primary coil of the step-up transformer 568, the chopper 566, and a switch 582 operated by the receiver 564 (or alternatively the transceiver 564). A secondary coil of the step-up transformer 568 is coupled in series with the capacitor 572 and the diode 570, which has its anode coupled to the capacitor 572 and its cathode coupled to the secondary coil of the step-up transformer 568. The capacitor 572 is coupled in series with a primary coil of the high-voltage coil 576 and the spark gap 574, which is also coupled to the capacitor 572 at the anode of the diode 570. The secondary coil of the high-voltage coil 576 is coupled across corresponding pairs of the electrodes 556.

Alternatively, the electric circuit 560 may be similar to those depicted in FIGS. 2 through 6 and described above.

The electric circuit 560 shown is capable of generating an output voltage at the electrodes 556 of approximately 50 kV (open circuit) from the battery 562, which may be a 6-volt to 9-volt battery, e.g., a 9-Volt battery. As mentioned above, such output voltage is capable of generating a spark across a gap of several centimeters, e.g., 5 centimeters, thereby enabling the projectile 550 to deliver an electric shock to the target, even if the electrodes 556 are not in direct physical contact with the target's skin.

The spring loaded locking mechanism 558 of FIG. 16 includes the spring 580, which in the embodiment of FIG. 16 is used to push the electrodes 556 forward through the adhesive-containing capsule 512.

Figure 17:
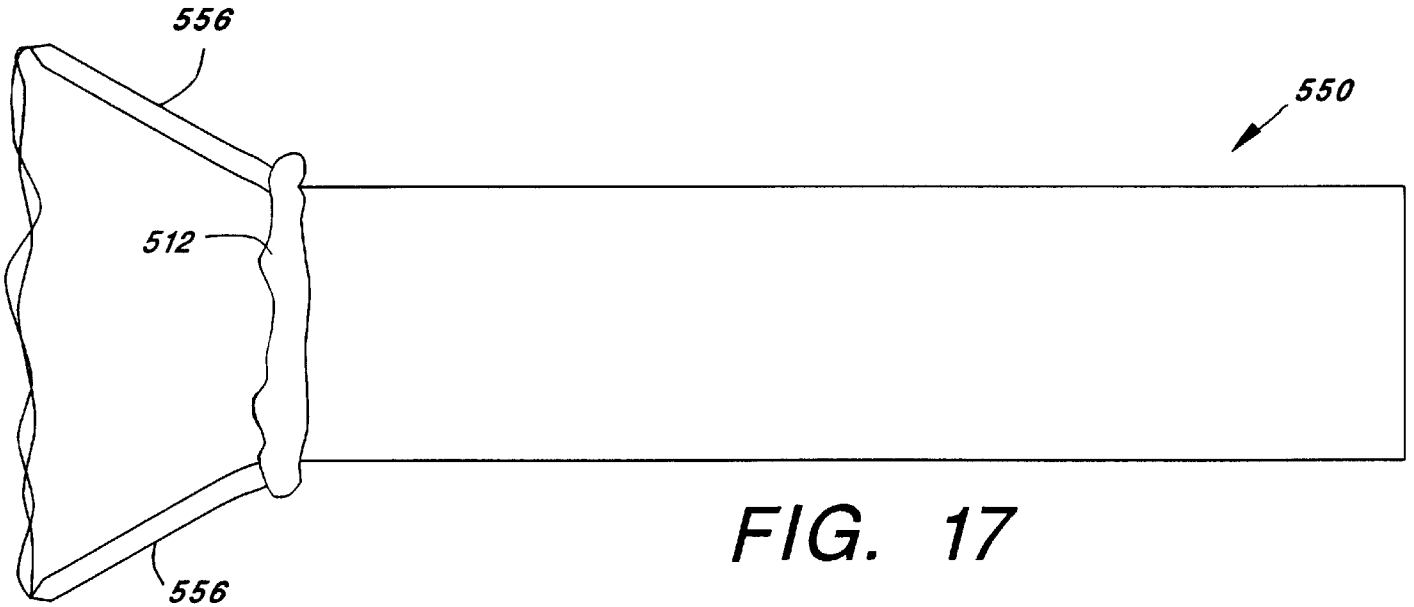
FIG. 17 is a side view of the embodiment of the non-lethal projectile of FIG. 16, wherein the plurality of electrodes are deployed.

Referring next to FIG. 17, a side view is shown of the other embodiment of the non-lethal projectile 550, wherein the plurality of electrodes 556 are deployed through the adhesive-containing capsule 512 and wherein the adhesive-containing capsule 512 is ruptured, as would be the case after the projectile 550 strikes the target.

As shown, the electrodes 556 have been deployed by the spring-loaded locking mechanism 558 (FIG. 16) through the adhesive-containing capsule 556. Thus, as a result, the adhesive contained within the adhesive-containing capsule 556 has been released and is now situated to adhere to the target coming in contact with the front end of the projectile 550.

Figure 18:
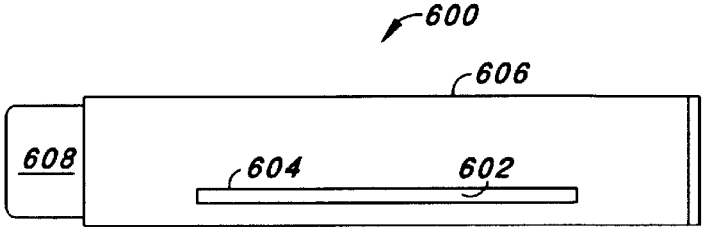
FIG. 18 is a side view of a further embodiment of the non-lethal projectile of FIG. 1, wherein a plurality of hinged electrodes are deployable through longitudinal slots.

Referring next to FIG. 18, a side view is shown of a further embodiment of the non-lethal projectile 600, wherein a plurality of hinged electrodes 602 are deployable through longitudinal slots 604 in the body 606 of the projectile 600. In the embodiment shown, three electrodes 602 pivot out from the projectile body 606 upon impact of the projectile 600 against the target. This activity is initiated by the depression of a plunger 608 located at the forward end of the projectile 600, which plunger 608 releases the electrodes 602 and pushes them along an accurate path toward the forward end of the projectile body 606 and the target. Upon coming near to, or contacting the target, an electric shock can be delivered to the target using, for example, one of the electric circuits described herein.

Figure 19:
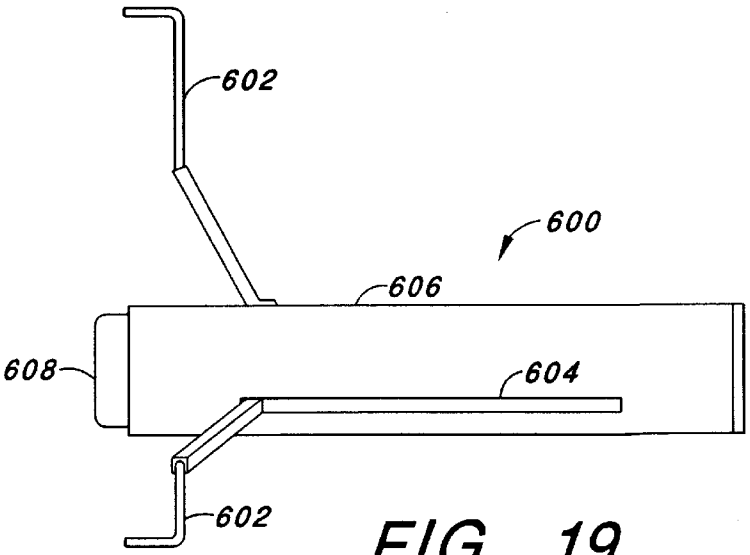
FIG. 19 is a side view of the further embodiment of the non-lethal projectile of FIG. 18, wherein the plurality of hinged electrodes are deployed.

Referring to FIG. 19, a side view is shown of the further embodiment of the non-lethal projectile 600, wherein the plurality of hinged electrodes 602 are deployed. As can be seen, the electrodes 602, of which there are three in the embodiment shown, are in a deployed position, having been pivoted forward toward the target following impact of the projectile 600 against the target. As can also be seen, the plunger 608 is in a depressed position such as is the case after the projectile 600 impacts against the target.

Figure 20:
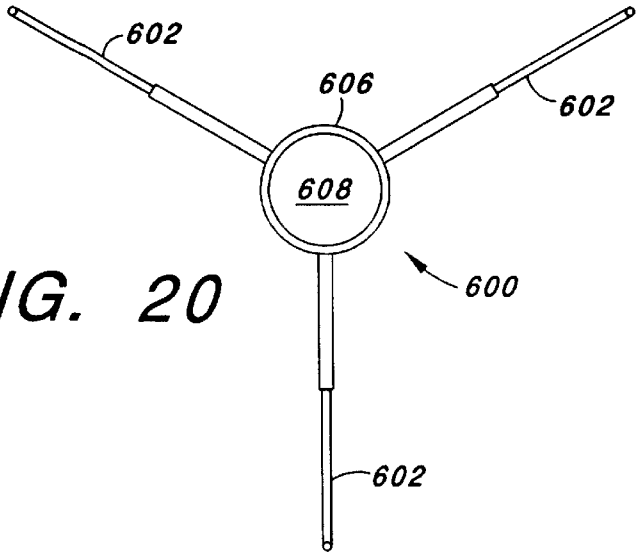
FIG. 20 is a front view of the further embodiment of the non-lethal projectile of FIG. 18, wherein the plurality of hinged electrodes are deployed.

Referring to FIG. 20, a front view is shown of the further embodiment of the non-lethal projectile 600, wherein The plurality of hinged electrodes 602 are deployed. As can be seen, the electrodes 602 are deployed toward the target and are position at approximately 120° orientations relative to one another. In the embodiment shown, one or two of the electrodes 602 may be one polarity, while the other one or two electrodes 602 may be of another polarity. In a variation of the present embodiment, the plunger 608 may serve as an electrode of one polarity while the three hinged electrodes 602 serve as electrodes of an opposite polarity.

Figure 21:
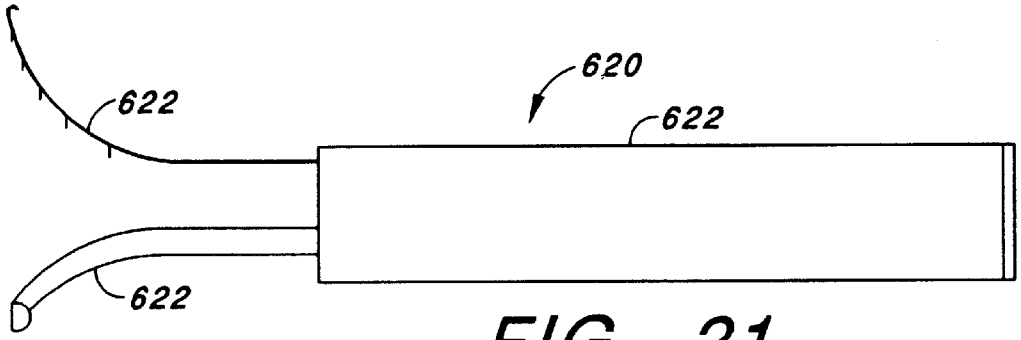
FIG. 21 is a side view of an additional embodiment of the non-lethal projectile of FIG. 1, wherein a plurality of barbed spring electrodes are positioned at a forward end of the non-lethal projectile.

Referring to FIG. 21, a side view is shown of an additional embodiment of the non-lethal projectile 620, wherein a plurality of barbed spring electrodes 622 are positioned at a forward end of the body 624 the non-lethal projectile 620. The three such barbed spring electrodes 622 are positioned so as to impact against the target. Upon impact the spring electrodes 622 spread radially outward exposing the barbs thereon to the target's clothing. As the projectile 620 recoils from its initial impact, the spring electrodes 622 return to their natural position, causing the barbs thereon to engage and hold the projectile 620 against the target. From this position, the electric circuit within the projectile 620 is able to deliver the high voltage electric shocks to the target through the barbed spring electrodes 622.

Figure 22:
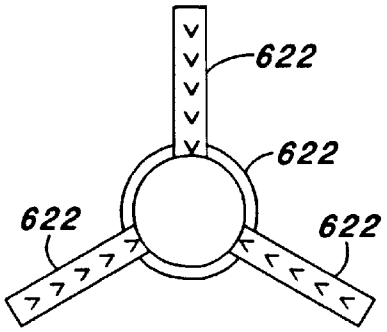
FIG. 22 is a front view of the additional embodiment of the non-lethal projectile of FIG. 21.

Referring to FIG. 22, a front view is shown of the additional embodiment of the non-lethal projectile 620. Shown are the barbed spring electrodes 622 positioned to impact against and engage the target upon impact of the projectile 620 against the target.

Figure 23:
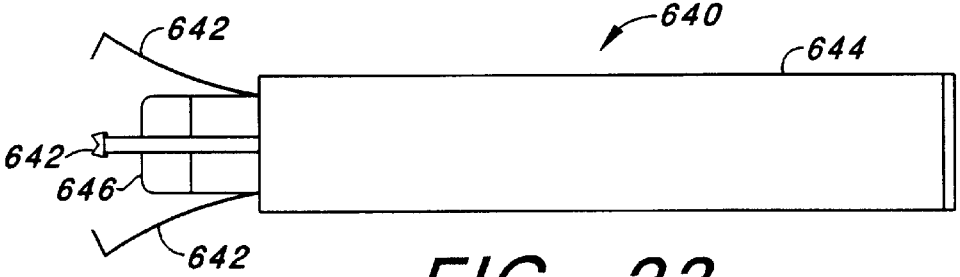
FIG. 23 is a side view of a further additional embodiment of the non-lethal projectile of FIG. 1, wherein a plurality of claw-like electrodes positioned at a forward end of the projectile are retractable so as to grab a target upon impact.

Referring to FIG. 23, a side view is shown of a further additional embodiment of the non-lethal projectile 640, wherein a plurality of claw-like electrodes 642 positioned at a forward end of the body 644 of the projectile 644 are retractable so as to grab a target upon impact. Shown are the claw-like electrodes 642 in an open position such as would be their position prior to the launching of the projectile 640. Also shown is a trigger 646 located between the claw-like electrodes 642 that, once impacted against the target causes the claw-like electrodes 642 to retract and engage, for example, the target's clothing.

Figure 24:
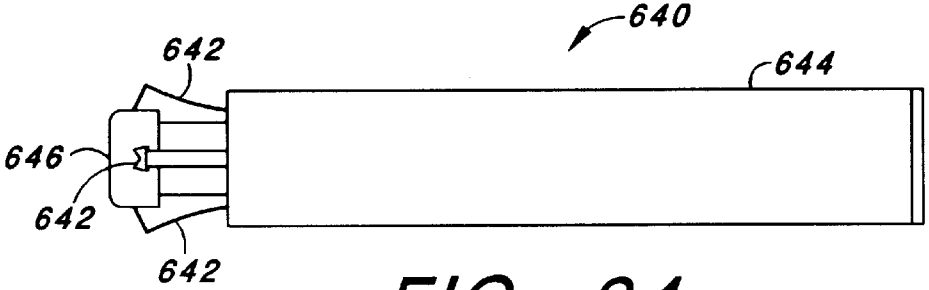
FIG. 24 is a side view of the further additional embodiment of the projectile of FIG. 23, wherein the plurality of claw-like electrodes are retracted.

Referring to FIG. 24, a side view is shown of the further additional embodiment of the projectile, wherein the plurality of claw-like electrodes 642 are retracted. As can be seen, the claw-like electrodes 642 are pulled back into the projectile body 644 and engaged against the trigger 646 so as to engage, for example, the target's clothing between the claw-like electrodes 642 and the trigger 646.

Figure 25:
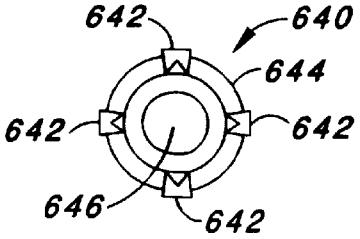
FIG. 25 is a front view of the further embodiment of FIG. 23, wherein the plurality of claw-like electrodes are retracted.

Referring to FIG. 25, a front view is shown of the further embodiment of the projectile 640, wherein the plurality of claw-like electrodes 642 are retracted and engaged against the trigger 646.

Figures 26, 27, 28, 29:
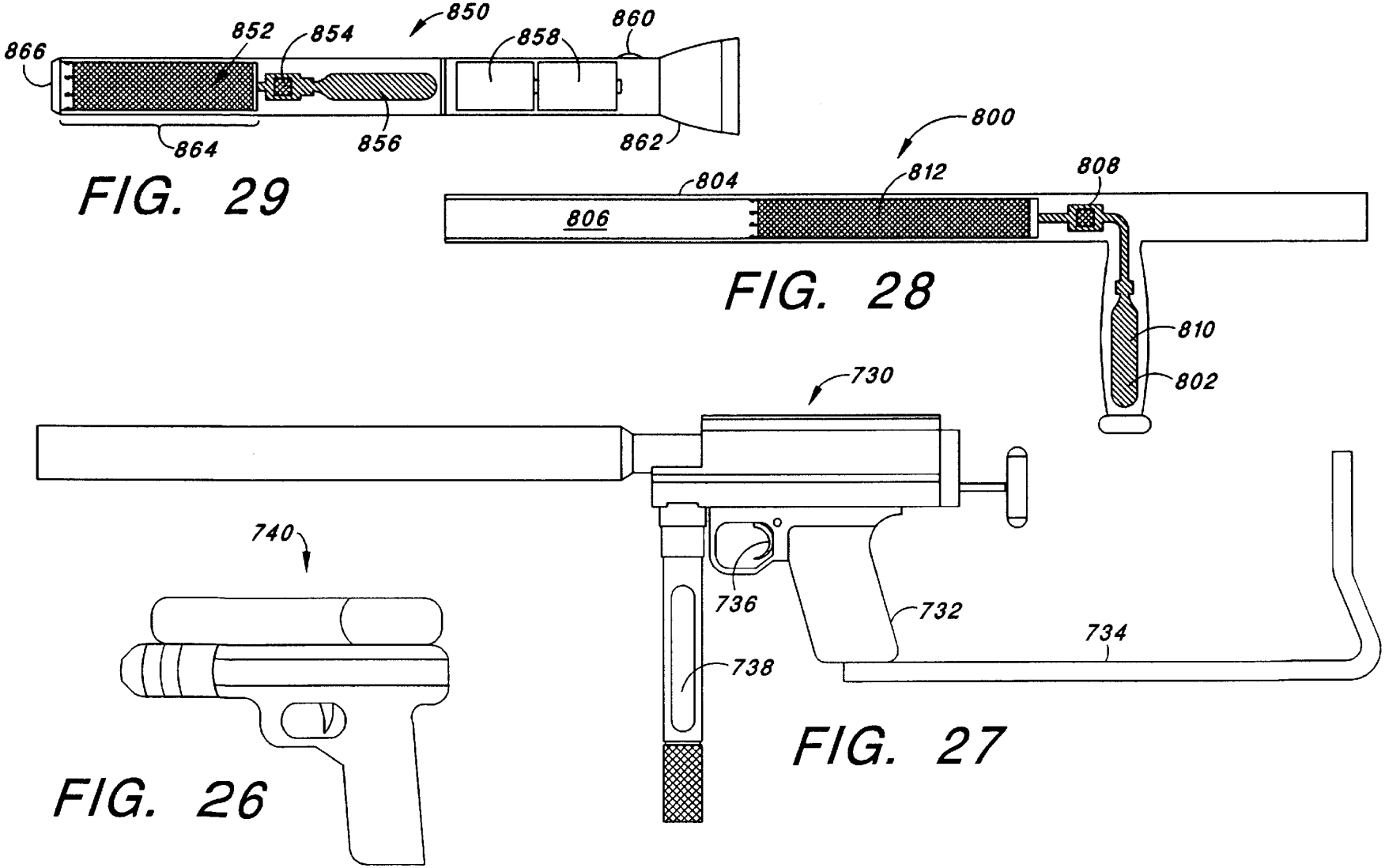
FIG. 26 is a side view of one embodiment of a launch device in the form of a pistol, suitable for launching, for example, the projectile of FIG. 1.
FIG. 27 is a side view of another embodiment of a launch device, in the form of a rifle, suitable for launching, for example, the projectile of FIG. 1.
FIG. 28 is a cross-sectional view of a further embodiment of a launch device in the form of a PR24 baton, suitable for launching, for example, the projectile of FIG. 13.
FIG. 29 is a cross sectional view of another further embodiment of a launch device in the form of a flashlight, suitable for launching, for example, the projectile of FIG. 1.

Referring next to FIG. 26, a side view is shown of one embodiment of the launch device 740, in the form of a pistol 740, suitable for launching the non-lethal projectiles described herein. A commercially available pistol 740, suitable for modification and use with the projectiles described herein is the Sheridan paintball pistol Model P.G.P. available from Sheridan Products of New York. The Sheridan paintball pistol, with a minimum of modifications, provides a relatively compact launch device that can be holstered. The pistol has launch characteristics suitable for close range use. Rapid fire capabilities however are limited by the operator's ability to quickly pump and reload the launch device, because the Sheridan Paintball Pistol is air-pump operated.

Referring next to FIG. 27, a side view is shown of another embodiment of a launch device 730 in the form of a rifle 730, suitable for launching the non-lethal projectiles described herein. The rifle 730 is gas-operated, using, e.g., compressed carbon dioxide gas 738 to propel the projectile. The rifle 730 may be in the form of a conventional rifle, having a grip 732, a stock 734, a trigger 736 etc. In variations of the present embodiment the rifle 730 may employ a chemical propellant load, instead of being gas operated, and in further variations may be in the form or an M203 grenade launcher—utilized either independently or attached to an M16 rifle.

Preferably, propulsion for the projectile is self-contained in the launch device 730 (or delivery system) and employs either a compressed gas 738, such as the carbon dioxide gas, mentioned above-(or in the variation mentioned above a chemically-generated gas propellent, such as black powder). The range of the delivery system 730 is preferably at least approximately 30 feet, but distances of up to, or more than 100 feet are possible using the embodiments ad variations thereof described herein. The velocity of the projectile when it contacts the target is preferably around 20 to 125, e.g., 80 feet per second. If a combination of mechanical (i.e., kinetic) stunning, as, for example, is used in heretofore known "rubber bullet"-type projectiles, and electrical stunning, as is used in the embodiments described herein, is desired, even higher impact velocities may be desirable, and are contemplated by the inventors of the present embodiments.

In some embodiments, the rifle 730 may be very similar in structure to the STINGRAY or TIGER SHARK paintball rifle available from Brass Eagle of Arizona; the SNIPER or AUTOCOCKER paintball rifle available from wORR GAME PRODUCTS of California; or the PRO-LITE paintball rifle from Tippmenn Pneumatics, Inc. of Indiana. These paintball rifles are carbon dioxide, i.e., $CO_2$, cylinder-operated, and many similar models are readily commercially available. Such rifles, as marketed, have an easily removable barrel (making it readily modifiable with a larger caliber barrel, such as a 38 mm barrel), and are semi-automatic in operation, making rapid firing possible. One possible modification to these rifles is the addition of an ammunition clip to allow a magazine of projectiles to be held for rapid firing from the rifle.

Referring to FIG. 28, a cross-sectional view is shown of a further embodiment of a launch device 800 in the form of a PR24 baton 800, suitable for launching the non-lethal projectiles described herein. Shown is a handle 802 and a baton 804, a distal part of which has been hollowed out to serve as a barrel 806 through which the projectile may be fired. Also shown is a valve switch 808, a carbon dioxide cartridge 810, and a projectile 812. The projectile 812 is positioned within the barrel 806, and is held in place, e.g., by friction until needed. The valve switch 808 is coupled between the barrel 806 and the carbon dioxide cartridge 810, and holds the carbon dioxide gas within the carbon dioxide cartridge 810 until firing of the projectile 812 is desired.

In operation, when the firing of the projectile 812 is desired, the user of the launch device 800 depicted depresses a button that activates the valve switch 808 and releases the contents of the carbon dioxide cartridge 810. Release of carbon dioxide gas from the carbon dioxide cartridge 810 into the barrel 806 forces the projectile 812 out of the barrel 806 at a high velocity, thereby launching the projectile 812. When properly aimed, the present embodiment can be used to direct the projectile 812 to a target, and thereby in accordance with the teachings above, deliver a high-voltage electric shock to the target. At the same time, however, the launch device 800 of the present embodiment may be used in a conventional manner as a police baton for striking the target, and thereby subduing the target in a conventional manner.

Referring to FIG. 29, a cross-sectional view is shown of another further embodiment of a launch device 850 in the form of a flashlight 850, suitable for launching the non-lethal projectiles described herein. Shown is the projectile 852, the valve switch 854, and the carbon dioxide cartridge 856. Also shown is a pair of "D" cell batteries 858, a light switch 860, and a reflector housing 862. The batteries 858, light switch 860, reflector housing 862, and other components (not shown) function in a conventional manner as a flashlight while the remainder of the launch device 850, while appearing to be an ordinary flashlight, serve the purpose of launching the projectile 852. A portion of the flashlight 850 is hollowed out for use as a barrel 864, and the projectile 852 is held in such barrel 864 by, e.g., friction or by an end cap 866 until it is launched. The valve switch 854 is coupled to the barrel 864 and to the carbon dioxide cartridge 856, and holds the contents of the carbon dioxide cartridge 856 within the carbon dioxide cartridge 856 until launch of the projectile 852 is desired.

In operation, when launch of the projectile 852 is desired, the user of the launch device 850 depresses a button on the launch device 850 that opens the valve switch 854, thereby releasing the contents of the carbon dioxide cartridge 856 into the barrel 864. This releases carbon dioxide behind the projectile 852, which forces the projectile 852 out of the barrel 864 at high velocity. In this manner, the projectile 852 can be fired at a target so as to deliver the high voltage electric shock to the target, as further described hereinabove.

While the invention herein disclosed has been described by means of specific embodiments and applications thereof, numerous modifications and variations could be made thereto by those skilled in the art without departing from the scope of the invention set forth in the claims.

What is claimed is:

1. A projectile for delivering a stunning electrical shock to a target comprising:

a projectile body;

an electric circuit housed within the projectile body for generating an electric shock;

a plurality of electrodes, coupled to the electric circuit, for delivering the electric shock to the target; and attachment means coupled to the projectile body, for attaching the projectile to the target, the attachment means including:

an adhesive-containing capsule coupled to said projectile body;

an adhesive material contained within the adhesive-containing capsule until impact of said projectile against said target, the adhesive-containing capsule rupturing upon impact of said projectile against said target, and, in response to the rupturing, releasing the adhesive material onto said target.

2. The projectile of claim 1 wherein said adhesive-containing capsule comprises plastic.

3. The projectile of claim 1 wherein said adhesive-containing capsule comprises wax.

4. The projectile of claim 1 wherein said adhesive-containing capsule comprises paper.

5. The projectile of claim 1 wherein said adhesive-containing capsule comprises acrylic-coated paper.

6. The projectile of claim 1 wherein said adhesive-containing capsule comprises gelatin.

7. The projectile of claim 1 further comprising:

a plurality of barbed tips coupled to said projectile body; and a removable cover removably coupled to said projectile body, the removable cover covering the plurality of barbed tips, said adhesive material being on the removable cover.

8. The projectile of claim 1 further comprising:

a radio receiver coupled to said electric circuit for deactivating said electric circuit, in response to a deactivation signal.

9. The projectile of claim 1, further comprising:

a radio receiver coupled to said electric circuit for activating said electric circuit in response to an activation signal.

10. The projectile of claim 9 wherein said plurality of electrodes comprises at least two electrodes.

11. The projectile of claim 1 wherein said electric shock has an open circuit voltage of at least 20 kV.

12. The projectile of claim 11 wherein said electric shock has a current of at least 3 A.

13. The projectile of claim 1 wherein said electric circuit comprises a battery.

14. The projectile of claim 13 wherein said battery has a voltage of from between 6 and 9 volts.

15. The projectile of claim 1 further comprising:

a momentum switch for activating said electric circuit upon impact of said projectile against said target.

16. The projectile of claim 1 further comprising:

an arming switch for arming said electric circuit.

17. The projectile of claim 16 further comprising:

an arming pin removable from said arming switch for arming said electric circuit upon removal of the arming pin.

18. The projectile of claim 17 wherein said arming pin opens a momentum switch when inserted into said arming switch.

19. The projectile of claim 1 wherein said plurality of electrodes includes:

a first electrode comprising a first band of metal; and a second electrode comprising a second band of metal.

20. The projectile of claim 1 wherein said plurality of electrodes includes:

a first electrode positioned near a forward end of the projectile.

21. The projectile of claim 20 wherein said plurality of electrodes includes:

a second electrode positioned near a rearward end of the projectile.

22. The projectile of claim 1 further comprising:

a spark gap breakdown path coupled in parallel with a pair of said plurality of electrodes.

23. The projectile of claim 1 further comprising:

a timing circuit coupled to said electric circuit for terminating said delivering of said electrical shock a prescribed period of time after said delivering of said electrical shock begins.

24. A method of inhibiting a living target comprising:

firing a projectile at the target;

adhering the projectile to the target including rupturing an adhesive-containing capsule;

generating a voltage within the projectile; and delivering an electrical shock to the target using the voltage having been generated.

25. The method of claim 24 further comprising:

receiving a deactivation signal using a radio receiver; and stopping said delivering of said electrical shock in response to the receiving of the deactivation signal.

26. The method of claim 24 wherein said firing comprises firing the projectile a distance of at least 10 meters.

27. The method of claim 24 wherein said firing comprises firing the projectile using carbon dioxide.

28. The method of claim 24 wherein said firing comprises firing the projectile using black powder.

29. The method of claim 24 wherein said firing comprises firing the projectile using air.

30. The method of claim 24 wherein said generating said voltage within the projectile includes generating an open circuit voltage of at least 30 kV.

31. The method of claim 24 wherein said generating said voltage within the projectile includes generating a current of at least 3 A.

32. A system for delivering a stunning-electrical shock to a target comprising:

a launch device;

a projectile comprising:

a projectile body;

an electric circuit housed within the projectile body;

a plurality of electrodes, coupled to the electric circuit, for delivering an electrical shock to the target;

an adhesive material for adhering to the target;

an adhesive-containing capsule coupled to a front end of said projectile body;

said adhesive material being contained within the adhesive-containing capsule until said impact of said projectile against said target; and the adhesive-containing capsule rupturing upon said impact of said projectile against said target, and, in response to the rupturing, releasing said adhesive material onto said target.

33. The system of claim 32 further comprising:

a radio receiver coupled to said electric circuit for deactivating said electric circuit in response to a deactivation signal so as to not deliver said electric shock; and a radio transmitter for generating the deactivation signal.

34. The system of claim 33 wherein:

said radio receiver coupled to said electric circuit is for activating said electric circuit in response to an activation signal so as to deliver said electric shock; and said radio transmitter is for generating the activation signal.

35. A projectile for delivering a stunning electrical shock to a target comprising:

a projectile body;

an electric circuit housed within the projectile body for generating an electric shock;

a plurality of electrodes, coupled to the electric circuit, for delivering an electrical shock to the target;

attachment means, coupled to the projectile body, for attaching the projectile to the target, the attachment means comprising:

an adhesive material; and an adhesive-containing capsule coupled to said projectile body, said adhesive-containing capsule containing said adhesive material until impact of said projectile against said target, and releasing the adhesive material onto said target upon impact of said projectile against said target.

36. The projectile of claim 35 further comprising:

a spring loaded locking mechanism coupled to said plurality of electrodes for deploying said plurality of electrodes toward said target upon releasing of the spring loaded locking mechanism; and a release switch coupled to the spring loaded locking mechanism, and to a front end of the projectile body, for releasing the spring loaded locking mechanism upon impact of said projectile against said target, whereby said plurality of electrodes are deployed toward said target upon the impact of said projectile against said target.

37. The projectile of claim 36 wherein said plurality of electrodes, after said deployment, protrude through openings in a periphery of said projectile body at said front end.

38. The projectile of claim 36 wherein said plurality of electrodes, after said deployment, protrude through said adhesive-containing capsule.

39. A projectile for delivering a stunning electrical shock to a target comprising:

a projectile body;

an electric circuit housed within the projectile body for generating an electric shock;

a plurality of-electrodes, coupled to the electric circuit, for delivering an electrical shock to the target; and attachment means, coupled to the projectile body, for attaching the projectile to the target, the attachment means comprising an adhesive material;

a plurality of barbed tips coupled to said projectile body; and a removable cover removably coupled to said projectile body, the removable cover covering the plurality of barbed tips, said adhesive material being on the removable cover.

40. The projectile of claim 39 further comprising:

a radio receiver coupled to said electric circuit for deactivating said electric circuit, in response to a deactivation signal.

41. The projectile of claim 40 further comprising:

a radio receiver coupled to said electric circuit for activating said electric circuit in response to an activation signal.

42. The projectile of claim 39 wherein said electric shock has an open circuit voltage of at least 20 kV.

43. The projectile of claim 42 wherein said electric shock has a current of at least 3 A.

44. The projectile of claim 39 wherein said electric circuit comprises a battery.

45. The projectile of claim 44 wherein said battery has a voltage of from between 6 and 9 volts.

46. The projectile of claim 39 further comprising:

a momentum switch for activating said electric circuit upon impact of said projectile against said target.

47. The projectile of claim 39 further comprising:

an arming switch for arming said electric circuit.

48. The projectile of claim 47 further comprising:

an arming pin removable from said arming switch for arming said electric circuit upon removal of the arming pin.

49. The projectile of claim 48 wherein said arming pin opens a momentum switch when inserted into said arming switch.

50. The projectile of claim 39 wherein said plurality of electrodes includes:

a first electrode positioned near a forward end of the projectile.

51. The projectile of claim 50 wherein said plurality of electrodes includes:

a second electrode positioned near a rearward end of the projectile.

52. The projectile of claim 50 wherein said plurality of electrodes includes:

a second electrode positioned near a central region of the projectile.

53. The projectile of claim 39 further comprising:

a spark gap breakdown path coupled in parallel with a pair of said plurality of electrodes.

54. The projectile of claim 39 further comprising:

a timing circuit coupled to said electric circuit for terminating said delivering of said electrical shock a prescribed period of time after said delivering of said electrical shock begins.

55. A projectile for delivering a stunning electrical shock to a target comprising:

a projectile body, the projectile body being elongated and substantially cylindrical;

an electric circuit housed within the projectile body for generating an electric shock;

a plurality of electrodes, coupled to the electric circuit, for delivering an electrical shock to the target, the plurality of electrodes comprising:

a first electrode comprising a first band of metal fixed at a perimeter of the projectile body; and a second electrode comprising a second band of metal fixed at said perimeter of the projectile body; and attachment means, coupled to the projectile body, for attaching the projectile to the target, the attachment means comprising an adhesive material.

56. A method of inhibiting a living target comprising:

firing a projectile at the target;

impacting the target with the projectile having been fired;

rupturing an adhesive-containing capsule upon said impacting said target with said projectile having been fired;

adhering the projectile to the target with an adhesive;

generating a voltage within the projectile; and delivering an electrical shock to the target using the voltage having been generated.

57. The method of claim 56 further comprising:

deploying a plurality or electrodes toward said target; and said delivering being through at least two of the plurality of electrodes.

58. The method of claim 57 wherein said firing comprises firing the projectile a distance of at least 10 meters.

59. The method of claim 57 wherein said generating said voltage within the projectile includes generating an open circuit voltage of at least 30 kV.

60. The method of claim 57 wherein said generating said voltage within the projectile includes generating a current of at least 3 A.

61. A system for delivering a stunning electrical shock to a target comprising:

a launch device; and a projectile comprising:

a projectile body;

an electric circuit housed within the projectile body;

a plurality of electrodes, coupled to the electric circuit, for delivering an electrical shock to the target;

an adhesive-containing capsule coupled to the projectile body; and an adhesive material contained within the adhesive-containing capsule until impact of the projectile against said target and releasing the adhesive material onto the target upon impact of the projectile against the target.

62. The system of claim 61 further comprising:

a radio receiver coupled to said electric circuit for deactivating said electric circuit in response to a deactivation signal so as to not deliver said electric shock; and a radio transmitter for generating the deactivation signal.

63. The system of claim 62 further wherein:

said radio receiver coupled to said electric circuit is for activating said electric circuit in response to an activation signal so as to deliver said electric shock; and said radio transmitter is for generating the activation signal.

* * * * *